US008705783B1

(12) United States Patent
Mishra et al.

(10) Patent No.: US 8,705,783 B1
(45) Date of Patent: Apr. 22, 2014

(54) METHODS AND SYSTEMS FOR ACOUSTICALLY CONTROLLING A COCHLEAR IMPLANT SYSTEM

(75) Inventors: Lakshmi N. Mishra, Valencia, CA (US); Manohar Joshi, Los Angeles, CA (US); Guillermo A. Calle, Moorpark, CA (US); Abhijit Kulkarni, Newbury Park, CA (US); Lee F. Hartley, Valencia, CA (US)

(73) Assignee: Advanced Bionics, Valencia, CA (US)

( * ) Notice: Subject to any disclaimer, the term of this patent is extended or adjusted under 35 U.S.C. 154(b) by 327 days.

(21) Appl. No.: 12/910,396

(22) Filed: Oct. 22, 2010

Related U.S. Application Data

(60) Provisional application No. 61/254,302, filed on Oct. 23, 2009.

(51) Int. Cl.
*H04R 25/00* (2006.01)

(52) U.S. Cl.
USPC ..... 381/315; 381/312; 381/314

(58) Field of Classification Search
CPC .... H04R 25/00; H04R 25/558; H04R 25/554; H04R 25/505; H04R 25/552; H04R 25/70; H04R 25/556; H04R 2420/07; H04R 5/04; H04R 2430/01; H04R 25/606; H04R 25/55; H04R 2225/61; H04R 2225/41; H04R 2225/67; H04R 2225/43; H03G 1/02; A61N 1/36032; H04B 1/202; H04L 1/0009; H04W 84/18; H04W 4/20
USPC ..... 381/315, 323, 312, 314
See application file for complete search history.

(56) References Cited

U.S. PATENT DOCUMENTS

| | | | | |
|---|---|---|---|---|
| 4,790,019 | A * | 12/1988 | Hueber | 381/315 |
| 4,845,755 | A | 7/1989 | Busch et al. | |
| 4,918,736 | A * | 4/1990 | Bordewijk | 381/315 |
| 8,169,938 | B2 * | 5/2012 | Duchscher et al. | 370/310 |
| 8,170,677 | B2 * | 5/2012 | Chambers et al. | 607/55 |
| 8,170,678 | B2 * | 5/2012 | Polak | 607/57 |
| 8,175,306 | B2 * | 5/2012 | Meskens et al. | 381/315 |
| 2002/0012438 | A1 * | 1/2002 | Leysieffer et al. | 381/312 |
| 2010/0074451 | A1 * | 3/2010 | Usher et al. | 381/58 |
| 2010/0241195 | A1 * | 9/2010 | Meadows et al. | 607/62 |

* cited by examiner

*Primary Examiner* — Ahmad Matar
*Assistant Examiner* — Sabrina Diaz
(74) *Attorney, Agent, or Firm* — ALG Intellectual Property, LLC

(57) ABSTRACT

An exemplary method of acoustically controlling a cochlear implant system includes acoustically transmitting, by a remote control subsystem, a control signal comprising one or more control parameters, detecting, by a sound processing subsystem communicatively coupled to a stimulation subsystem implanted within a patient, the control signal, extracting, by the sound processing subsystem, the one or more control parameters from the control signal, and performing, by the sound processing subsystem, at least one operation in accordance with the one or more control parameters. Corresponding methods and systems are also described.

20 Claims, 20 Drawing Sheets

METHODS AND SYSTEMS FOR ACOUSTICALLY CONTROLLING A COCHLEAR IMPLANT SYSTEM

RELATED APPLICATIONS

The present application claims priority under 35 U.S.C. §119(e) to U.S. Provisional Patent Application No. 61/254,302 by Lakshmi N. Mishra et al., filed on Oct. 23, 2009, and entitled "Methods and Systems for Acoustically Controlling a Cochlear Implant System," the contents of which are hereby incorporated by reference in their entirety.

BACKGROUND

The sense of hearing in human beings involves the use of hair cells in the cochlea that convert or transduce acoustic signals into auditory nerve impulses. Hearing loss, which may be due to many different causes, is generally of two types: conductive and sensorineural. Conductive hearing loss occurs when the normal mechanical pathways for sound to reach the hair cells in the cochlea are impeded. These sound pathways may be impeded, for example, by damage to the auditory ossicles. Conductive hearing loss may often be overcome through the use of conventional hearing aids that amplify sound so that acoustic signals can reach the hair cells within the cochlea. Some types of conductive hearing loss may also be treated by surgical procedures.

Sensorineural hearing loss, on the other hand, is caused by the absence or destruction of the hair cells in the cochlea which are needed to transduce acoustic signals into auditory nerve impulses. People who suffer from sensorineural hearing loss may be unable to derive significant benefit from conventional hearing aid systems, no matter how loud the acoustic stimulus is. This is because the mechanism for transducing sound energy into auditory nerve impulses has been damaged. Thus, in the absence of properly functioning hair cells, auditory nerve impulses cannot be generated directly from sounds.

To overcome sensorineural hearing loss, numerous cochlear implant systems—or cochlear prostheses—have been developed. Cochlear implant systems bypass the hair cells in the cochlea by presenting electrical stimulation directly to the auditory nerve fibers. Direct stimulation of the auditory nerve fibers leads to the perception of sound in the brain and at least partial restoration of hearing function.

It is often desirable to selectively control how a cochlear implant system operates. For example, it is often desirable to change volume and/or sensitivity levels associated with a cochlear implant system and/or direct the cochlear implant system to switch to a different operating mode or program. Current mechanisms for controlling an operation of a cochlear implant system are limited and difficult to use.

SUMMARY

An exemplary method of acoustically controlling a cochlear implant system includes a remote control subsystem acoustically transmitting, by a remote control subsystem, a control signal comprising one or more control parameters, detecting, by a sound processing subsystem communicatively coupled to a stimulation subsystem implanted within a patient, the control signal, extracting, by the sound processing subsystem, the one or more control parameters from the control signal, and performing, by the sound processing subsystem, at least one operation in accordance with the one or more control parameters.

Another exemplary method includes detecting, by a sound processing subsystem communicatively coupled to a stimulation subsystem implanted within a patient, an acoustically transmitted control signal comprising one or more control parameters, extracting, by the sound processing subsystem, the one or more control parameters from the control signal, and performing, by the sound processing subsystem, at least one operation in accordance with the one or more control parameters.

An exemplary method of remotely fitting a cochlear implant system to a patient includes streaming an audio file to from a first computing device to a second computing device over a network, the audio file comprising a control signal that includes one or more fitting parameters. The method further includes the second computing device acoustically presenting the audio file to the patient. The method further includes a sound processing subsystem included within the cochlear implant system detecting the control signal, extracting the one or more fitting parameters from the control signal, and performing at least one fitting operation in accordance with the one or more fitting parameters.

An exemplary system for acoustically controlling a cochlear implant system includes a remote control device configured to acoustically transmit a control signal comprising one or more control parameters and a sound processor communicatively coupled to the remote control subsystem and configured to detect the control signal, extract the one or more control parameters from the control signal, and perform at least one operation in accordance with the one or more control parameters.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Methods and systems for acoustically controlling a cochlear implant system are described herein. In some examples, a remote control subsystem acoustically transmits (e.g., by way of a speaker) a control signal comprising one or more control parameters to a sound processing subsystem communicatively coupled to a stimulation subsystem implanted within a patient. The sound processing subsystem detects (e.g., with a microphone) the control signal, extracts the one or more control parameters from the control signal, and performs at least one operation in accordance with the one or more control parameters.

Many advantages are associated with the methods and systems described herein. For example, remote control of a cochlear implant system obviates the need for physical controls (e.g., dials, switches, etc.) to be included on or within a speech processor. The speech processor may therefore be more compact, lightweight, energy efficient, and aesthetically pleasing. Moreover, a greater amount of control over the operation of the cochlear implant system may be provided to a user of the remote control as compared with current control configurations.

In some examples, the methods and systems described herein may be implemented by simply upgrading software components within cochlear implant systems currently in use by patients. In this manner, a patient would not have to obtain a new sound processor and/or add new hardware to an existing speech processor in order to realize the benefits associated with the methods and systems described herein.

The methods and systems described herein further facilitate remote fitting of a cochlear implant system to a patient over the Internet or other type of network. In this manner, a patient does not have to visit a clinician's office every time he or she needs to adjust one or more fitting parameters associated with his or her cochlear implant system.

Figure 1:
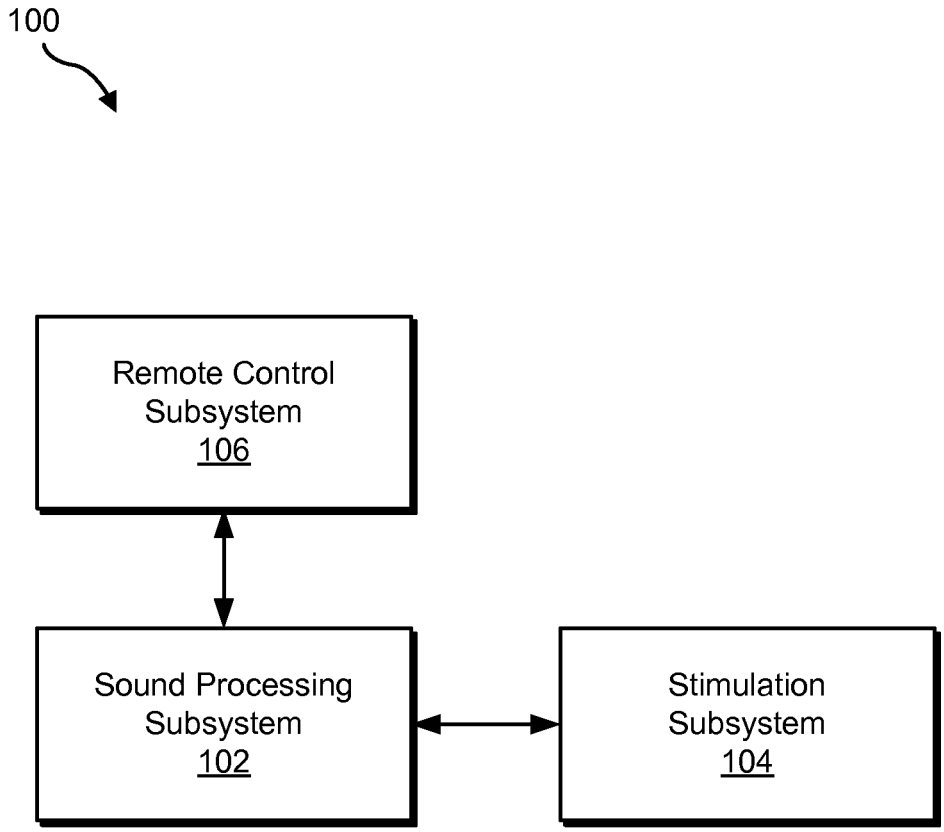
FIG. 1 illustrates an exemplary system for remotely controlling a cochlear implant system according to principles described herein.

FIG. 1 illustrates an exemplary system 100 for remotely controlling a cochlear implant system. As shown in FIG. 1, system 100 may include a sound processing subsystem 102 and a stimulation subsystem 104 configured to communicate with one another. System 100 may also include a remote control subsystem 106 configured to communicate with sound processing subsystem 102. As will be described in more detail below, system 100 may be configured to facilitate remote control of one or more operations performed by sound processing subsystem 102 and/or stimulation subsystem 104.

In some examples, sound processing subsystem 102 may be configured to detect or sense an audio signal and divide the audio signal into a plurality of analysis channels each containing a frequency domain signal (or simply "signal") representative of a distinct frequency portion of the audio signal. Sound processing subsystem 102 may the generate one or more stimulation parameters based on the frequency domain signals and direct stimulation subsystem 104 to generate and apply electrical stimulation to one or more stimulation sites in accordance with the one or more stimulation parameters. The stimulation parameters may control various parameters of the electrical stimulation applied to a stimulation site by stimulation subsystem 104 including, but not limited to, a stimulation configuration, a frequency, a pulse width, an amplitude, a waveform (e.g., square or sinusoidal), an electrode polarity (i.e., anode-cathode assignment), a location (i.e., which electrode pair or electrode group receives the stimulation current), a burst pattern (e.g., burst on time and burst off time), a duty cycle or burst repeat interval, a spectral tilt, a ramp on time, and a ramp off time of the stimulation current that is applied to the stimulation site.

Sound processing subsystem 102 may be further configured to detect a control signal acoustically transmitted by remote control subsystem 106. As will be described in more detail below, the acoustically transmitted control signal may include one or more control parameters configured to govern one or more operations of sound processing subsystem 102 and/or stimulation subsystem 104. These control parameters may be configured to specify one or more stimulation parameters, operating parameters, and/or any other parameter as may serve a particular application. Exemplary control parameters include, but are not limited to, volume control parameters, program selection parameters, operational state parameters (e.g., parameters that turn a sound processor and/or an implantable cochlear stimulator on or off), audio input source selection parameters, fitting parameters, noise reduction parameters, microphone sensitivity parameters, microphone direction parameters, pitch parameters, timbre parameters, sound quality parameters, most comfortable current levels ("M levels"), threshold current levels, channel acoustic gain parameters, front and backend dynamic range parameters, current steering parameters, pulse rate values, pulse width values, frequency parameters, amplitude parameters, waveform parameters, electrode polarity parameters (i.e., anode-cathode assignment), location parameters (i.e., which electrode pair or electrode group receives the stimulation current), stimulation type parameters (i.e., monopolar, bipolar, or tripolar stimulation), burst pattern parameters (e.g., burst on time and burst off time), duty cycle parameters, spectral tilt parameters, filter parameters, and dynamic compression parameters.

Sound processing subsystem 102 may be further configured to extract the one or more control parameters from the acoustically transmitted control signal and perform at least one operation in accordance with the one or more control parameters. For example, if the one or more control parameters indicate a desired change in a volume level associated with a representation of an audio signal to a patient, sound processing subsystem 102 may adjust the volume level associated with the representation of the audio signal to the patient accordingly.

Stimulation subsystem 104 may be configured to generate and apply electrical stimulation (also referred to herein as "stimulation current" and/or "stimulation pulses") to one or more stimulation sites within the cochlea of a patient as directed by sound processing subsystem 102. For example, stimulation subsystem 104 may be configured to generate and apply electrical stimulation in accordance with one or more stimulation parameters transmitted thereto by sound processing subsystem 102.

Figure 2:
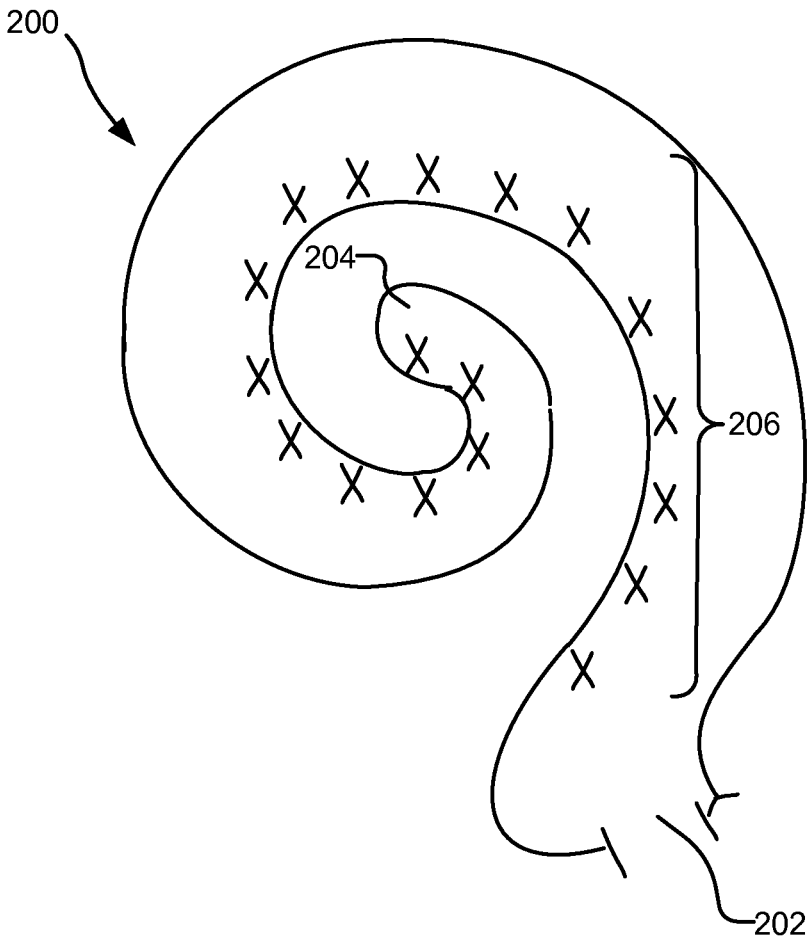
FIG. 2 illustrates a schematic structure of the human cochlea according to principles described herein.

The one or more stimulation sites to which electrical stimulation is applied may include any target area or location within the cochlea. FIG. 2 illustrates a schematic structure of the human cochlea 200. As shown in FIG. 2, the cochlea 200 is in the shape of a spiral beginning at a base 202 and ending at an apex 204. Within the cochlea 200 resides auditory nerve tissue 206, which is denoted by Xs in FIG. 2. The auditory nerve tissue 206 is organized within the cochlea 200 in a tonotopic manner. Low frequencies are encoded at the apex 204 of the cochlea 200 while high frequencies are encoded at the base 202. Hence, each location along the length of the cochlea 200 corresponds to a different perceived frequency. Stimulation subsystem 104 may therefore be configured to apply electrical stimulation to different locations within the cochlea 200 (e.g., different locations along the auditory nerve tissue 206) to provide a sensation of hearing.

Returning to FIG. 1, remote control subsystem 106 may be configured to acoustically transmit the control signal to sound processing subsystem 102. To this end, remote control subsystem 106 may receive input from a user indicative of a desired change in an operation of sound processing subsystem 102 and/or stimulation subsystem 104 and generate one or more control parameters representative of the desired change. The user may include a cochlear implant patient associated with sound processing subsystem 102 and stimulation subsystem 104, a clinician performing a fitting procedure on the cochlear implant patient, and/or any other user as may serve a particular application.

System 100, including sound processing subsystem 102, stimulation subsystem 104, and remote control subsystem 106 may include any hardware, computer-implemented instructions (e.g., software), firmware, or combinations thereof configured to perform one or more of the processes described herein. For example, system 100, sound processing subsystem 102, stimulation subsystem 104, and remote control subsystem 106 may include hardware (e.g., one or more signal processors and/or other computing devices) configured to perform one or more of the processes described herein.

One or more of the processes described herein may be implemented at least in part as instructions executable by one or more computing devices. In general, a processor receives instructions from a computer-readable medium (e.g., a memory, etc.) and executes those instructions, thereby performing one or more processes, including one or more of the processes described herein. Such instructions may be stored and/or transmitted using any of a variety of known computer-readable media.

A computer-readable medium (also referred to as a processor-readable medium) includes any medium that participates in providing data (e.g., instructions) that may be read by a computing device (e.g., by a processor within sound processing subsystem 102). Such a medium may take many forms, including, but not limited to, non-volatile media and/or volatile media. Exemplary computer-readable media that may be used in accordance with the systems and methods described herein include, but are not limited to, random access memory ("RAM"), dynamic RAM, a PROM, an EPROM, a FLASH-EEPROM, any other memory chip or cartridge, or any other medium from which a computing device can read.

Figure 3:
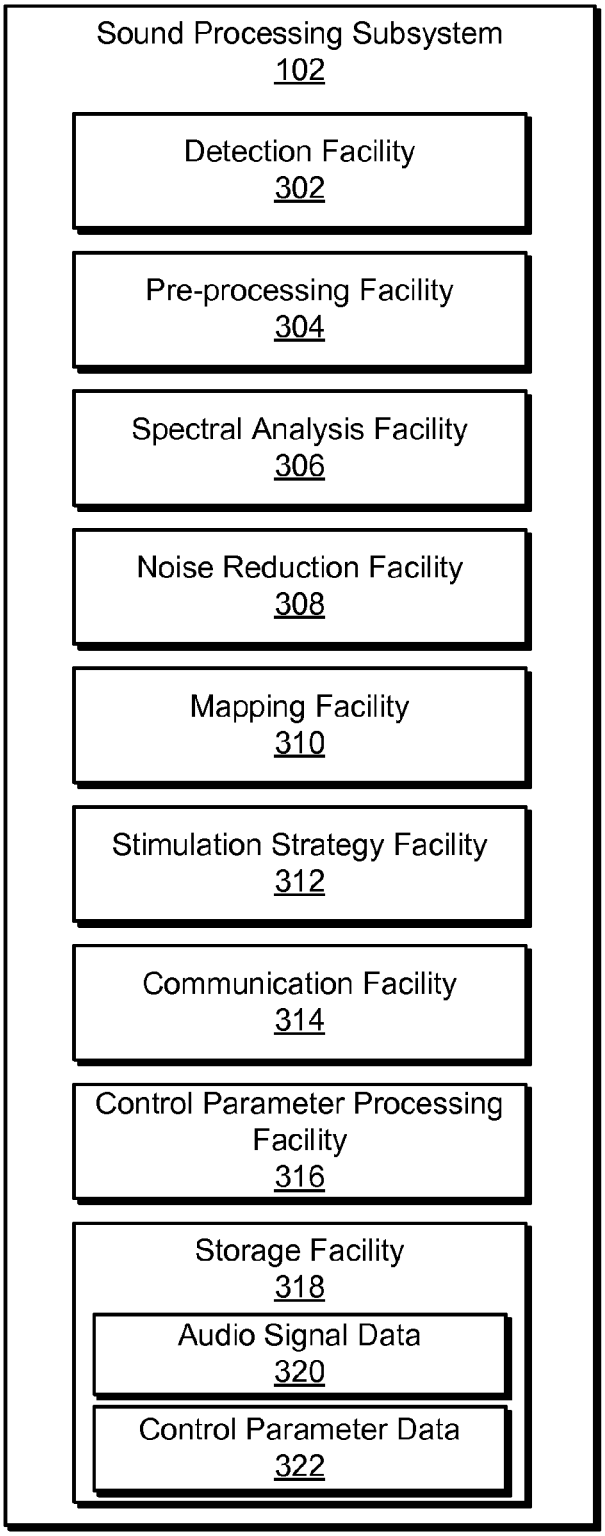
FIG. 3 illustrates exemplary components of a sound processing subsystem according to principles described herein.

FIG. 3 illustrates exemplary components of sound processing subsystem 102. As shown in FIG. 3, sound processing subsystem 102 may include a detection facility 302, a pre-processing facility 304, a spectral analysis facility 306, a noise reduction facility 308, a mapping facility 310, a stimulation strategy facility 312, a communication facility 314, a control parameter processing facility 316, and a storage facility 318, which may be in communication with one another using any suitable communication technologies. Each of these facilities 302-318 may include any combination of hardware, software, and/or firmware as may serve a particular application. For example, one or more of facilities 302-318 may include or be implemented by a computing device or processor configured to perform one or more of the functions described herein. Facilities 302-318 will now be described in more detail.

Detection facility 302 may be configured to detect or sense one or more audio signals and convert the detected signals to corresponding electrical signals. To this end, detection facility 302 may be implemented by a microphone or other transducer. In some examples, the one or more audio signals may include speech. The one or more audio signals may additionally or alternatively include music, ambient noise, and/or other sounds.

Detection facility 302 may be further configured to detect or sense one or more control signals acoustically transmitted by remote control subsystem 106. For example, a microphone or other transducer that implements detection facility 302 may detect the one or more control signals acoustically transmitted by remote control subsystem 106.

Pre-processing facility 304 may be configured to perform various signal processing operations on the one or more audio signals detected by detection facility 302. For example, pre-processing facility 304 may amplify a detected audio signal, convert the audio signal to a digital signal, filter the digital signal with a pre-emphasis filter, subject the digital signal to automatic gain control, and/or perform one or more other signal processing operations on the detected audio signal.

In some examples, detection facility 302 may simultaneously detect an audio signal and an acoustically transmitted control signal. For example, a cochlear implant patient associated with sound processing subsystem 102 may be listening to an audio signal comprising speech when remote control subsystem 106 acoustically transmits a control signal to sound processing subsystem 102. To this end, as will be described in more detail below, pre-processing facility 304 may be configured to separate or otherwise distinguish between a detected audio signal and a detected control signal.

Spectral analysis facility 306 may be configured to divide the audio signal into a plurality of analysis channels each containing a frequency domain signal representative of a distinct frequency portion of the audio signal. For example, spectral analysis facility 306 may include a plurality of band-pass filters configured to divide the audio signal into a plurality of frequency channels or bands. Additionally or alternatively, spectral analysis facility 306 may be configured to convert the audio signal from a time domain into a frequency domain and then divide the resulting frequency bins into the plurality of analysis channels. To this end, spectral analysis facility 306 may include one or more components configured to apply a Discrete Fourier Transform (e.g., a Fast Fourier Transform ("FFT")) to the audio signal.

Spectral analysis facility 306 may be configured to divide the audio signal into any number of analysis channels as may serve a particular application. In some examples, the total number of analysis channels is set to be less than or equal to a total number of stimulation channels through which electrical stimulation representative of the audio signal is applied to a cochlear implant patient.

Noise reduction facility 308 may be configured to apply noise reduction to the signals within the analysis channels in accordance with any suitable noise reduction heuristic as may serve a particular application. For example, noise reduction facility 308 may be configured to generate a noise reduction gain parameter for each of the signals within the analysis channels and apply noise reduction to the signals in accordance with the determined noise reduction gain parameters. It will be recognized that in some implementations, noise reduction facility 308 is omitted from sound processing subsystem 102.

Mapping facility 310 may be configured to map the signals within the analysis channels to electrical stimulation pulses to be applied to a patient via one or more stimulation channels. For example, signal levels of the noise reduced signals within the analysis channels are mapped to amplitude values used to define electrical stimulation pulses that are applied to the patient by stimulation subsystem 104 via one or more corresponding stimulation channels. Mapping facility 310 may be further configured to perform additional processing of the noise reduced signals contained within the analysis channels, such as signal compression.

Stimulation strategy facility 312 may be configured to generate one or more stimulation parameters based on the noise reduced signals within the analysis channels and in accordance with one or more stimulation strategies. Exemplary stimulation strategies include, but are not limited to, a current steering stimulation strategy and an N-of-M stimulation strategy.

Communication facility 314 may be configured to facilitate communication between sound processing subsystem 102 and stimulation subsystem 104. For example, communication facility 314 may include one or more coils configured to transmit control signals (e.g., the one or more stimulation parameters generated by stimulation strategy facility 312) and/or power via one or more communication links to stimulation subsystem 104. Additionally or alternatively, communication facility 314 may one or more wires or the like that are configured to facilitate direct communication with stimulation subsystem 104.

Communication facility 314 may be further configured to facilitate communication between sound processing subsystem 102 and remote control subsystem 106. For example, communication facility 314 may be implemented in part by a microphone configured to detect a control signal acoustically transmitted by remote control subsystem 106. Communication facility 314 may further include an acoustic transducer (e.g., a microphone, an acoustic buzzer, or other device) configured to transmit one or more status or confirmation signals to remote control subsystem 106.

Control parameter processing facility 316 may be configured to extract one or more control parameters included within a detected control signal and perform one or more operations in accordance with the one or more control parameters. Exemplary operations that may be performed in accordance with the one or more control parameters will be described in more detail below.

Storage facility 318 may be configured to maintain audio signal data 320 representative of an audio signal detected by detection facility 302 and control parameter data 322 representative of one or more control parameters. Storage facility 318 may be configured to maintain additional or alternative data as may serve a particular application.

Figure 4:
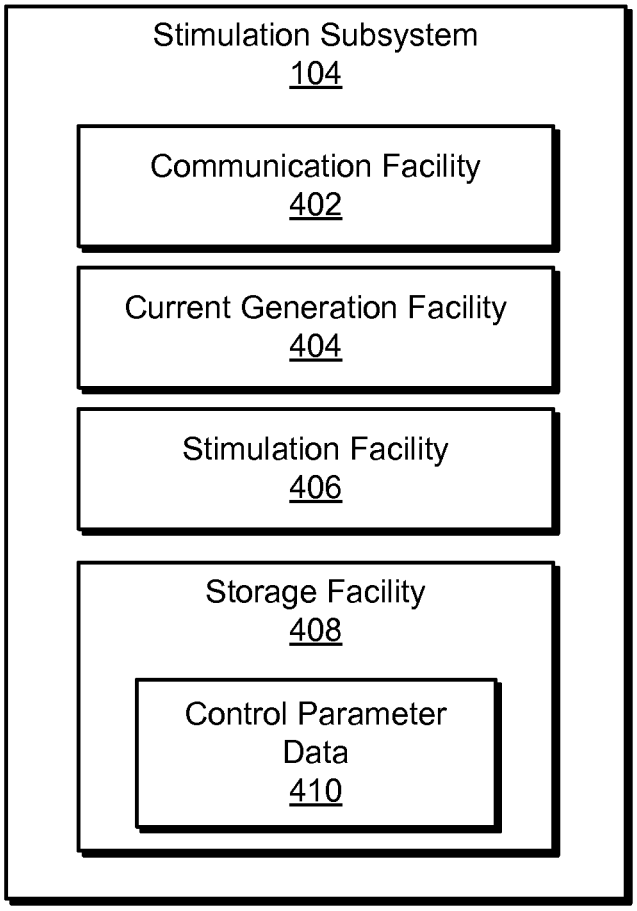
FIG. 4 illustrates exemplary components of a stimulation subsystem according to principles described herein.

FIG. 4 illustrates exemplary components of stimulation subsystem 104. As shown in FIG. 4, stimulation subsystem 104 may include a communication facility 402, a current generation facility 404, a stimulation facility 406, and a storage facility 408, which may be in communication with one another using any suitable communication technologies. Each of these facilities 402-408 may include any combination of hardware, software, and/or firmware as may serve a particular application. For example, one or more of facilities 402-408 may include a computing device or processor configured to perform one or more of the functions described herein. Facilities 402-408 will now be described in more detail.

Communication facility 402 may be configured to facilitate communication between stimulation subsystem 104 and sound processing subsystem 102. For example, communication facility 402 may include one or more coils configured to receive control signals and/or power via one or more communication links to stimulation subsystem 104. Communication facility 402 may additionally or alternatively be configured to transmit one or more status signals and/or other data to sound processing subsystem 102.

Current generation facility 404 may be configured to generate electrical stimulation in accordance with one or more stimulation parameters received from sound processing subsystem 102. To this end, current generation facility 404 may include one or more current generators and/or any other circuitry configured to facilitate generation of electrical stimulation.

Stimulation facility 406 may be configured to apply the electrical stimulation generated by current generation facility 404 to one or more stimulation sites within the cochlea of a patient in accordance with the one or more stimulation parameters generated by stimulation strategy facility 312. To this end, as will be illustrated in more detail below, stimulation facility 406 may include one or more electrodes disposed on a lead that may be inserted within the cochlea.

Storage facility 408 may be configured to maintain control parameter data 410 as received from sound processing subsystem 102. Control parameter data 410 may be representative of one or more control parameters configured to govern one or more operations of sound processing subsystem 102. For example, control parameters data 410 may include data representative of one or more stimulation parameters configured to define the electrical stimulation generated and applied by stimulation subsystem 104. Storage facility 408 may be configured to maintain additional or alternative data as may serve a particular application.

Figure 5:
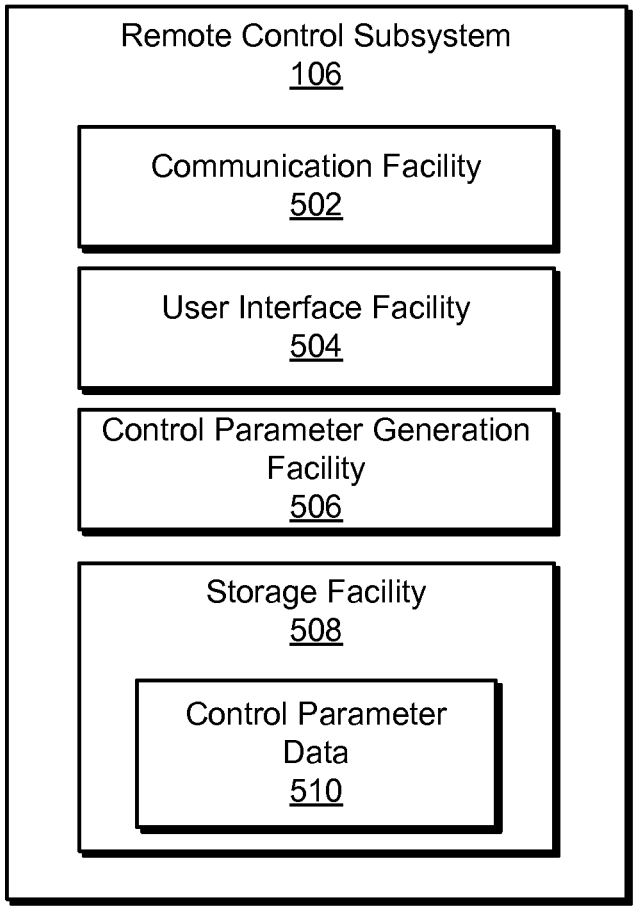
FIG. 5 illustrates exemplary components of a remote control subsystem according to principles described herein.

FIG. 5 illustrates exemplary components of remote control subsystem 106. As shown in FIG. 5, remote control subsystem 106 may include a communication facility 502, a user interface facility 504, a control parameter generation facility 506, and a storage facility 508, which may be in communication with one another using any suitable communication technologies. Each of these facilities 502-508 may include any combination of hardware, software, and/or firmware as may serve a particular application. For example, one or more of facilities 502-508 may include a computing device or processor configured to perform one or more of the functions described herein. Facilities 502-508 will now be described in more detail.

Communication facility 502 may be configured to facilitate communication between remote control subsystem 106 and sound processing subsystem 102. For example, communication facility 502 may be implemented in part by a speaker configured to acoustically transmit a control signal comprising one or more control parameters to sound processing subsystem 102. Communication facility 502 may also include a microphone configured to detect one or more status or confirmation signals transmitted by sound processing subsystem 102. Communication facility 502 may additionally or alternatively include any other components configured to facilitate wired and/or wireless communication between remote control subsystem 106 and sound processing subsystem 102.

User interface facility 504 may be configured to provide one or more user interfaces configured to facilitate user interaction with system 100. For example, user interface facility 504 may provide a user interface through which one or more functions, options, features, and/or tools may be provided to a user and through which user input may be received. In certain embodiments, user interface facility 504 may be configured to provide a graphical user interface ("GUI") for display on a display screen associated with remote control subsystem 106. The graphical user interface may be configured to facilitate inputting of one or more control commands by a user of remote control subsystem 106. For example, user interface facility 504 may be configured to detect one or more commands input by a user to direct sound processing subsystem 102 and/or stimulation subsystem 104 to adjust and/or perform one or more operations.

Control parameter generation facility 506 may be configured to generate one or more control parameters in response to user input. Control parameter generation facility 506 may also be configured to generate a control signal that includes the one or more control parameters. Exemplary control signals that may be generated by control parameter generation facility 506 will be described in more detail below.

Storage facility 508 may be configured to maintain control parameter data 510 representative of one or more control parameters generated by control parameter generation facility 506. Storage facility 508 may be configured to maintain additional or alternative data as may serve a particular application.

Remote control subsystem 106 may be implemented by any suitable computing device. For example, remote control subsystem 106 may be implemented by a remote control device, a mobile phone device, a handheld device (e.g., a personal digital assistant), a personal computer, an audio player (e.g., an mp3 player), and/or any other computing device as may serve a particular application.

Figure 6:
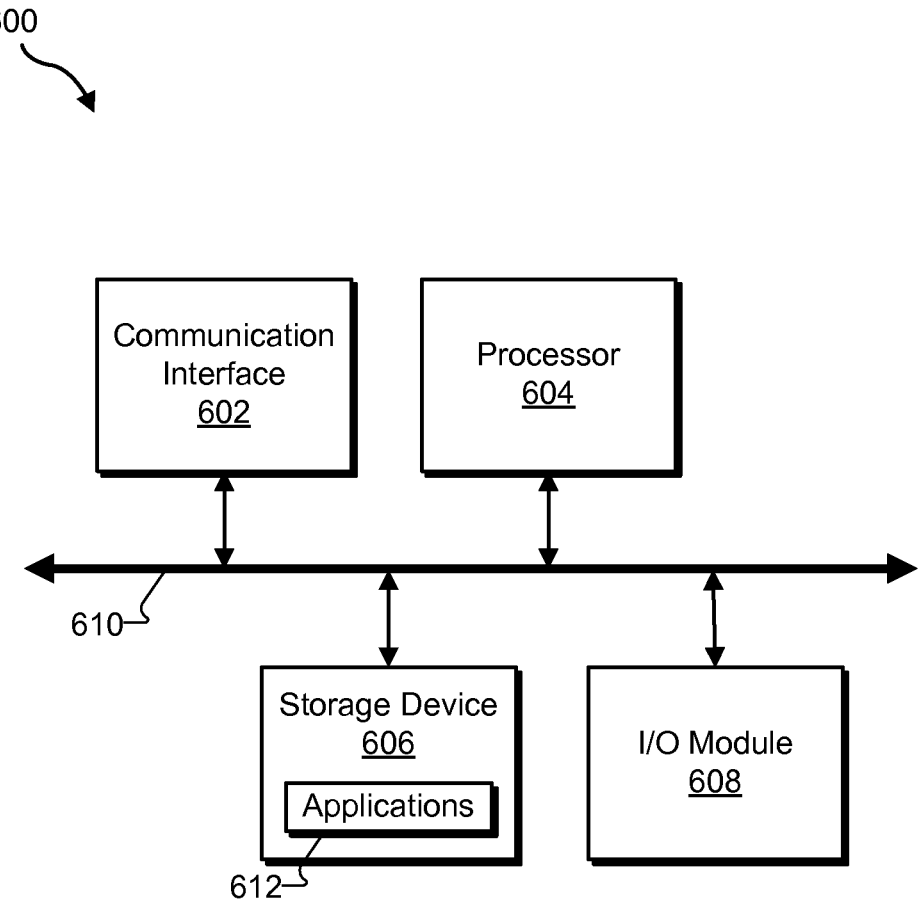
FIG. 6 illustrates exemplary components of a computing device that may implement one or more of the facilities of the remote control subsystem of FIG. 5 according to principles described herein.

FIG. 6 illustrates exemplary components of a computing device 600 that may implement one or more of the facilities 502-508 of remote control subsystem 106. As shown in FIG. 6, computing device 600 may include a communication interface 602, a processor 604, a storage device 606, and an I/O module 608 communicatively connected to one another via a communication infrastructure 610. While an exemplary computing device 600 is shown in FIG. 6, the components illustrated in FIG. 6 are not intended to be limiting. Additional or alternative components may be used in other embodiments. Components of computing device 600 shown in FIG. 6 will now be described in additional detail.

Communication interface 602 may be configured to communicate with one or more computing devices. In particular, communication interface 602 may be configured to transmit and/or receive one or more control signals, status signals, and/or other data. Examples of communication interface 602 include, without limitation, a speaker, a wireless network interface, a modem, and any other suitable interface. Communication interface 602 may be configured to interface with any suitable communication media, protocols, and formats.

Processor 604 generally represents any type or form of processing unit capable of processing data or interpreting, executing, and/or directing execution of one or more of the instructions, processes, and/or operations described herein. Processor 604 may direct execution of operations in accordance with one or more applications 612 or other computer-executable instructions such as may be stored in storage device 606 or another computer-readable medium.

Storage device 606 may include one or more data storage media, devices, or configurations and may employ any type, form, and combination of data storage media and/or device. For example, storage device 606 may include, but is not limited to, a hard drive, network drive, flash drive, magnetic disc, optical disc, random access memory ("RAM"), dynamic RAM ("DRAM"), other non-volatile and/or volatile data storage units, or a combination or sub-combination thereof. Electronic data, including data described herein, may be temporarily and/or permanently stored in storage device 606. For example, data representative of one or more executable applications 612 (which may include, but are not limited to, one or more software applications) configured to direct processor 604 to perform any of the operations described herein may be stored within storage device 606. In some examples, data may be arranged in one or more databases residing within storage device 606.

I/O module 608 may be configured to receive user input and provide user output and may include any hardware, firmware, software, or combination thereof supportive of input and output capabilities. For example, I/O module 608 may include hardware and/or software for capturing user input, including, but not limited to, speech recognition hardware and/or software, a keyboard or keypad, a touch screen component (e.g., touch screen display), a receiver (e.g., an RF or infrared receiver), and/or one or more input buttons.

I/O module 608 may include one or more devices for presenting output to a user, including, but not limited to, a graphics engine, a display (e.g., a display screen, one or more output drivers (e.g., display drivers), one or more audio speakers, and one or more audio drivers. In certain embodiments, I/O module 608 is configured to provide graphical data to a display for presentation to a user. The graphical data may be representative of one or more graphical user interfaces and/or any other view as may serve a particular application.

In some examples, any of facilities 502-508 may be implemented by or within one or more components of computing device 600. For example, one or more applications 612 residing within storage device 606 may be configured to direct processor 604 to perform one or more processes or functions associated with communication facility 502, user interface facility 504, and/or control parameter generation facility 506. Likewise, storage facility 508 may be implemented by or within storage device 606.

Figure 7:
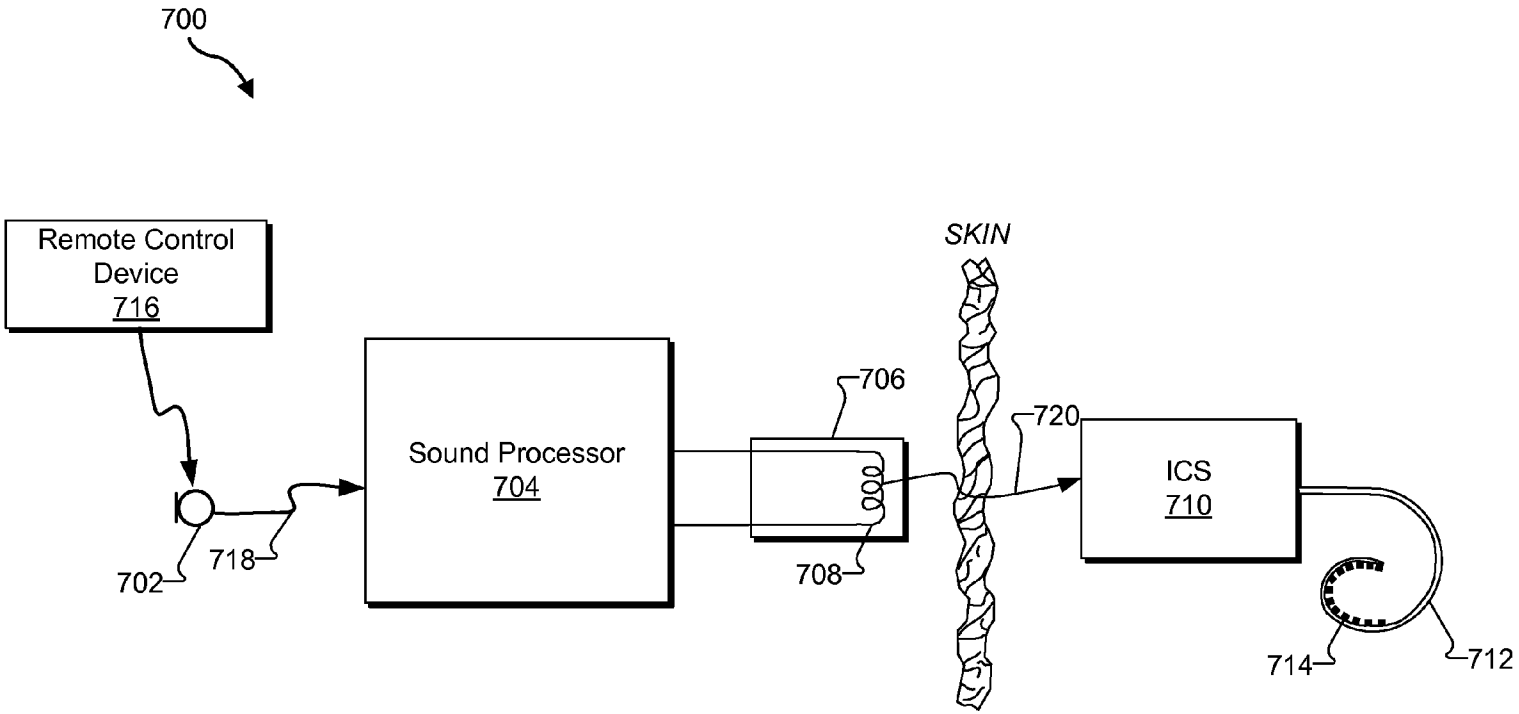
FIG. 7 illustrates an exemplary implementation of the cochlear implant system of FIG. 1 according to principles described herein.

FIG. 7 illustrates an exemplary implementation 700 of system 100. As shown in FIG. 7, implementation 700 may include a microphone 702, a sound processor 704, a headpiece 706 having a coil 708 disposed therein, an implantable cochlear stimulator ("ICS") 710, a lead 712, and a plurality of electrodes 714 disposed on the lead 712. Implementation 700 may additionally include a remote control device 716 selectively and communicatively coupled to sound processor 704. Additional or alternative components may be included within implementation 700 of system 100 as may serve a particular application. The facilities described herein may be implemented by or within one or more components shown within FIG. 7. For example, detection facility 302 may be implemented by microphone 702. Pre-processing facility 304, spectral analysis facility 306, noise reduction facility 308, mapping facility 310, stimulation strategy facility 312, and/or storage facility 318 may be implemented by sound processor 704. Communication facility 314 may be implemented by headpiece 706 and coil 708. Communication facility 402, current generation facility 404, and storage facility 408 may be implemented by implantable cochlear stimulator 708. Stimulation facility 406 may be implemented by lead 710 and electrodes 712. Communication facility 502, user interface facility 504, control parameter generation facility 506, and storage facility 508 may be implemented by remote control device 716.

As shown in FIG. 7, microphone 702, sound processor 704, and headpiece 706 may be located external to a cochlear implant patient. In some alternative examples, microphone 702 and/or sound processor 704 may be implanted within the patient. In such configurations, the need for headpiece 706 may be obviated.

In some examples, remote control device 716 may be configured to acoustically transmit a control signal using a speaker or other acoustic transducer. In some alternative examples, as will be described in more detail below, remote control device 716 may be configured to acoustically transmit the control signal over a wired communication channel.

Microphone 702 may detect the control signal acoustically transmitted by remote control device 716. Microphone 702 may be placed external to the patient, within the ear canal of the patient, or at any other suitable location as may serve a particular application. Sound processor 704 may process the detected control signal and extract one or more control parameters from the control signal. Sound processor 704 may then perform at least one operation in accordance with the extracted one or more control parameters.

Additionally or alternatively, microphone 702 may detect an audio signal containing acoustic content meant to be heard by the patient (e.g., speech) and convert the detected signal to a corresponding electrical signal. The electrical signal may be sent from microphone 702 to sound processor 704 via a communication link 718, which may include a telemetry link, a wire, and/or any other suitable communication link.

Sound processor 704 is configured to process the converted audio signal in accordance with a selected sound processing strategy to generate appropriate stimulation parameters for controlling implantable cochlear stimulator 710. Sound processor 704 may include or be implemented within a behind-the-ear ("BTE") unit, a portable speech processor ("PSP"), and/or any other sound processing unit as may serve a particular application.

Sound processor 704 may be configured to transcutaneously transmit data (e.g., data representative of one or more stimulation parameters) to implantable cochlear stimulator 704 via coil 708. As shown in FIG. 7, coil 708 may be housed within headpiece 706, which may be affixed to a patient's head and positioned such that coil 708 is communicatively coupled to a corresponding coil (not shown) included within implantable cochlear stimulator 710. In this manner, data may be wirelessly transmitted between sound processor 704 and implantable cochlear stimulator 710 via communication link 720. It will be understood that data communication link 118 may include a bi-directional communication link and/or one or more dedicated uni-directional communication links. In some alternative embodiments, sound processor 704 and implantable cochlear stimulator 710 may be directly connected with one or more wires or the like.

Implantable cochlear stimulator 710 may be configured to generate electrical stimulation representative of an audio signal detected by microphone 702 in accordance with one or more stimulation parameters transmitted thereto by sound processing subsystem 102. Implantable cochlear stimulator 710 may be further configured to apply the electrical stimulation to one or stimulation sites within the cochlea via one or more electrodes 714 disposed along lead 712. Hence, implantable cochlear stimulator 710 may be referred to as a multi-channel implantable cochlear stimulator 710.

To facilitate application of the electrical stimulation generated by implantable cochlear stimulator 710, lead 712 may be inserted within a duct of the cochlea such that electrodes 714 are in communication with one or more stimulation sites within the cochlea. As used herein, the term "in communication with" refers to electrodes 714 being adjacent to, in the general vicinity of, in close proximity to, directly next to, or directly on the stimulation site. Any number of electrodes 714 (e.g., sixteen) may be disposed on lead 712 as may serve a particular application.

Figure 8:
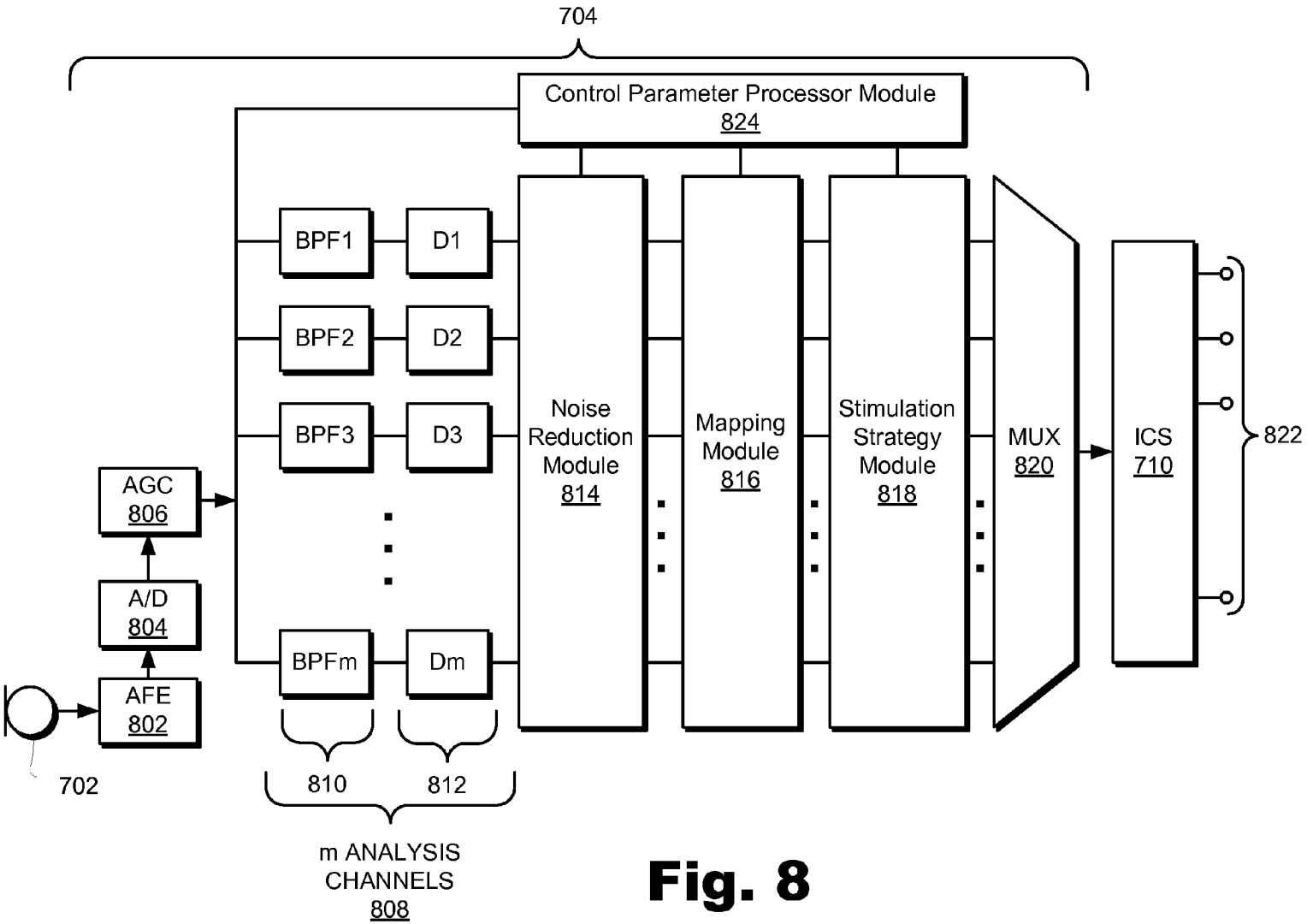
FIG. 8 illustrates components of an exemplary sound processor coupled to an implantable cochlear stimulator according to principles described herein.

FIG. 8 illustrates components of an exemplary sound processor 704 coupled to an implantable cochlear stimulator 710. The components shown in FIG. 8 may be configured to perform one or more of the processes associated with one or more of the facilities 302-318 associated with sound processing subsystem 102 and are merely representative of the many different components that may be included within sound processor 704.

As shown in FIG. 8, microphone 702 senses an audio signal, such as speech or music, and converts the audio signal into one or more electrical signals. These signals are then amplified in audio front-end ("AFE") circuitry 802. The amplified audio signal is then converted to a digital signal by an analog-to-digital ("A/D") converter 804. The resulting digital signal is then subjected to automatic gain control using a suitable automatic gain control ("AGC") unit 806.

After appropriate automatic gain control, the digital signal is subjected to a plurality of filters 810 (e.g., a plurality of band-pass filters). Filters 810 are configured to divide the digital signal into m analysis channels 808 each containing a signal representative of a distinct frequency portion of the audio signal sensed by microphone 702. Additional or alternative components may be used to divide the signal into the analysis channels 808 as may serve a particular application. For example, as described previously, one or more components may be included within sound processor 704 that are configured to apply a Discrete Fourier Transform to the audio signal and then divide the resulting frequency bins into the analysis channels 808.

As shown in FIG. 8, the signals within each analysis channel 808 may be input into an energy detector 812. Each energy detector 812 may include any combination of circuitry configured to detect an amount of energy contained within each of the signals within the analysis channels 808. For example, each energy detector 812 may include a rectification circuit followed by an integrator circuit.

After energy detection, the signals within the m analysis channels 808 may be input into a noise reduction module 814. Noise reduction module 814 may perform one or more of the functions described in connection with noise reduction facility 308. For example, noise reduction module 814 may generate a noise reduction gain parameter for each of the signals within analysis channels 808 based on a signal-to-noise ratio of each respective signal and apply noise reduction to the signals in accordance with the determined noise reduction gain parameters.

Mapping module 816 may perform one or more of the functions described in connection with mapping facility 310. For example, mapping module 816 may map the signals in the analysis channels 808 to one or more stimulation channels after the signals have been subjected to noise reduction by noise reduction module 814. For example, signal levels of the noise reduced signals generated by noise reduction module 814 are mapped to amplitude values used to define the electrical stimulation pulses that are applied to the patient by implantable cochlear stimulator 710 via M stimulation channels 822. In some examples, groups of one or more electrodes 714 may make up the M stimulation channels 822.

Stimulation strategy module 818 may perform one or more of the functions described in connection with stimulation strategy facility 312. For example, stimulation strategy module 818 may generate one or more stimulation parameters by selecting a particular stimulation configuration in which implantable cochlear stimulator 710 operates to generate and apply electrical stimulation representative of various spectral components of an audio signal.

Multiplexer 820 may be configured to serialize the stimulation parameters generated by stimulation strategy module 818 so that they can be transmitted to implantable cochlear stimulator 710 via coil 708. The implantable cochlear stimulator 710 may then generate and apply electrical stimulation via one or more of the M stimulation channels 822 to one or more stimulation sites within the duct of the patient's cochlea in accordance with the one or more stimulation parameters.

As shown in FIG. 8, sound processor 704 may include a control parameter processor module 824 configured to perform one or more of the functions associated with control parameter processing facility 316. For example, control parameter processing module 824 may be configured to extract one or more control parameters from a control signal detected by microphone 702 and perform one or more operations in accordance with the one or more control parameters.

Figure 9:
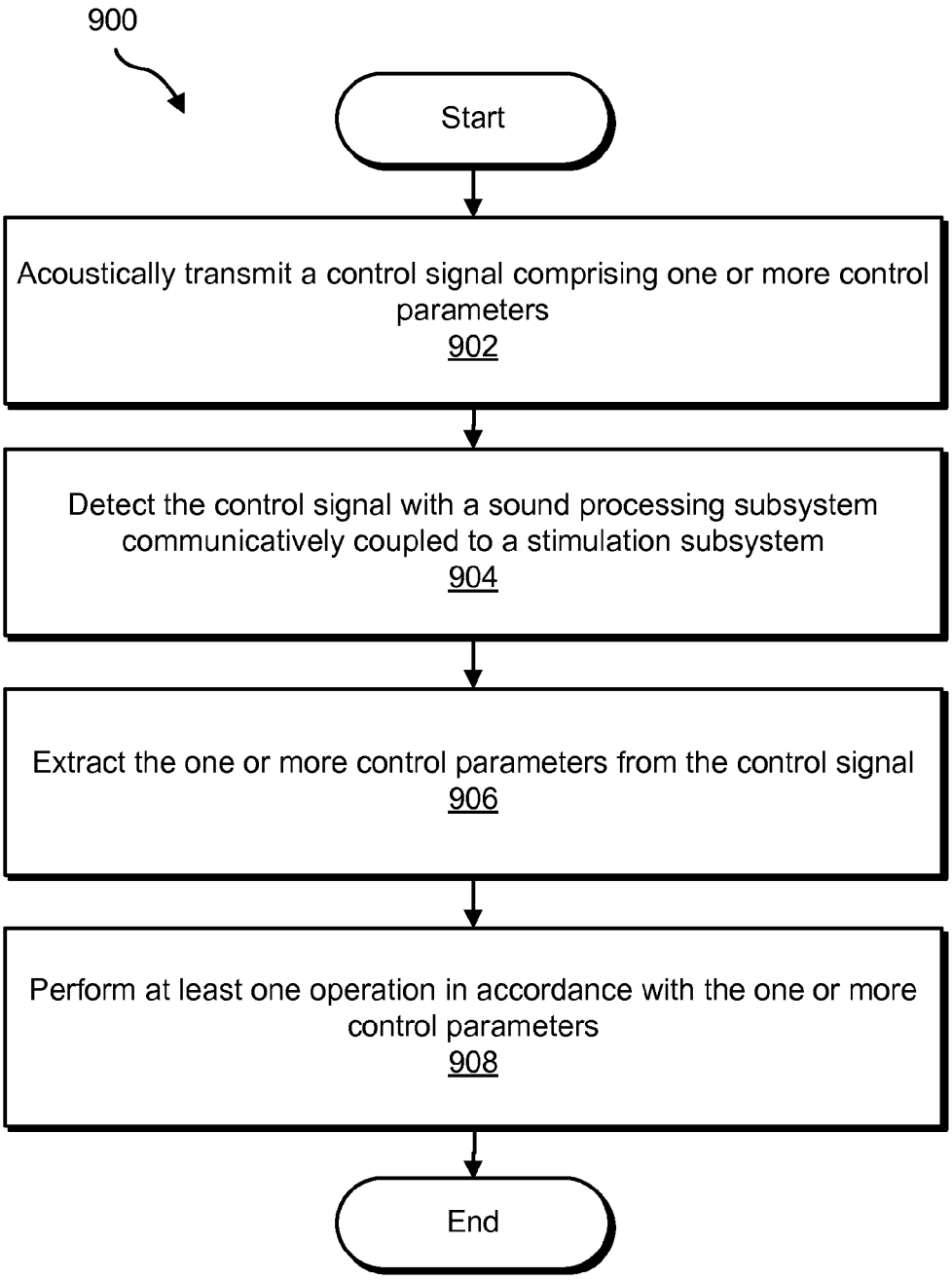
FIG. 9 illustrates an exemplary method of acoustically controlling a cochlear implant system according to principles described herein.

FIG. 9 illustrates an exemplary method 900 of acoustically controlling a cochlear implant system. While FIG. 9 illustrates exemplary steps according to one embodiment, other embodiments may omit, add to, reorder, and/or modify any of the steps shown in FIG. 9. It will be recognized that any of the systems, subsystems, facilities, and/or modules described herein may be configured to perform one or more of the steps shown in FIG. 9.

In step 902, a control signal comprising one or more control parameters is acoustically transmitted. For example, communication facility 502 of remote control subsystem 106 may acoustically transmit the control signal in response to a command input by a user of remote control subsystem 106 to direct sound processing subsystem 102 and/or stimulation subsystem 104 to adjust and/or perform one or more operations.

In some examples, in order to facilitate distinction by sound processing subsystem 102 between the control signal and an audio signal containing acoustic content meant to be heard by a patient, the control signal may be generated to include frequency content outside a frequency range associated with the audio signal. For example, most speech information within a typical audio signal is below 9 kHz. Hence, the control signal may be configured to include frequency content greater than 9 kHz. For example, a binary bit equal to 1 may be transmitted as a 14 kHz windowed frequency burst and a binary bit equal to 0 may be transmitted as a 10 kHz windowed frequency burst. It will be recognized that the control signal may include frequency content within any other suitable frequency range as may serve a particular application. However, for illustrative purposes only, it will be assumed in the examples given herein that binary 1's are transmitted as a 14 kHz windowed frequency burst and that binary 0's are transmitted as a 10 kHz windowed frequency burst.

Figure 10:
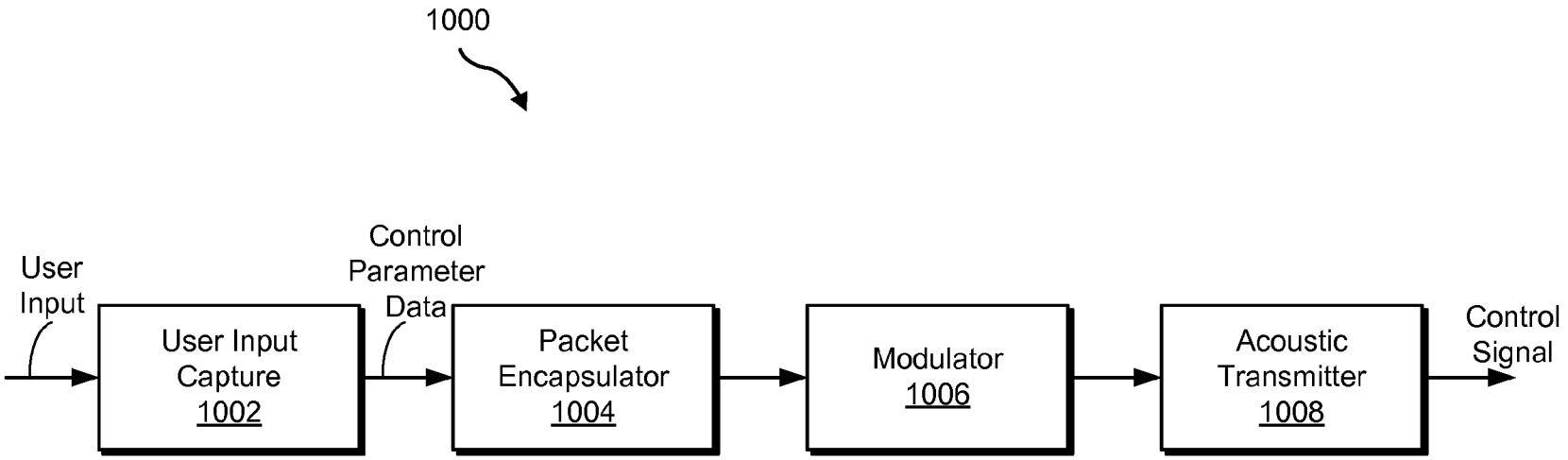
FIG. 10 illustrates an exemplary functional block diagram that may be implemented by a remote control subsystem in order to generate and transmit a control signal according to principles described herein.

FIG. 10 illustrates an exemplary functional block diagram 1000 that may be implemented by remote control subsystem 106 in order to generate and transmit a control signal. Any suitable combination of hardware, software, and/or firmware may be utilized to implement the function blocks shown in FIG. 10.

As shown in FIG. 10, a user input capture block 1002 may receive user input representative of one or more control parameters. For example, user input capture block 1002 may receive user input representative of a command to adjust a volume level, adjust a sensitivity level, switch to a different program, turn sound processor 704 on or off, and/or perform any other operation as may serve a particular application.

User input capture 1002 may translate the received user input into control parameter data representative of one or more corresponding control parameters. The control parameter data may comprise data bits representative of the control parameters and may be input into a packet encapsulator 1004.

Figure 11A:
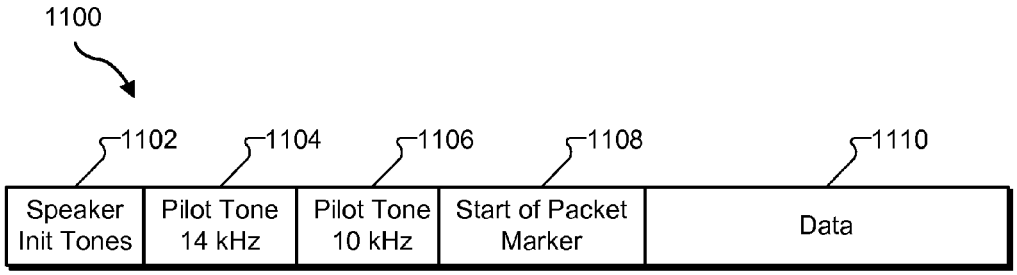
FIG. 11A illustrates an exemplary packet that may be generated with a packet encapsulator according to principles described herein.

Packet encapsulator 1004 may be configured to encapsulate the control parameter data into a packet that may be modulated with a carrier signal and transmitted to sound processing subsystem 102 via a speaker that is a part of remote control subsystem 106. For example, FIG. 11A illustrates an exemplary packet 1100 that may be generated with packet encapsulator 1004. As shown in FIG. 11A, packet 1100 may include speaker initialization tones 1102, pilot tones 1104 and 1106, a start of packet marker 1108, and data 1110. Each of these portions of packet 1100 will now be described.

Speaker initialization tones 1102 may include a relatively low volume tone burst comprising a mixture of two tones. The speaker initialization tones 1102 are played because the speaker may take some time (e.g., a few milliseconds) to generate sounds at a desired SPL level. Hence, the speaker initialization tones 1102 are played to initialize or prepare the speaker for transmission of the rest of packet 1100.

Pilot tones 1104 and 1106 include a sequence of windowed tone bursts of frequencies of 14 kHz and 10 kHz, respectively. Pilot tones 1104 and 1106 act as a marker for a valid packet and help sound processing subsystem 102 pick out genuine packets from noise. Two pilot tones are used to prevent false receiver receptions due to noise signals like claps, clicks, or other loud impulsive sounds.

In some examples, sound processing subsystem 102 may be configured to use the signal level at which the pilot tones 1104 and 1106 are received to adjust path gains in the receiver so that the signals in the receiver occupy the entire integer range.

Start of packet marker 1108 may include a bit pattern that includes alternating ones and zeros. This alternating bit pattern is transmitted as alternating tones of 14 kHz and 10 kHz. Start of packet marker 1108 may be configured to indicate to sound processing subsystem 102 a precise time at which to start sampling data 1110.

Figure 11B:
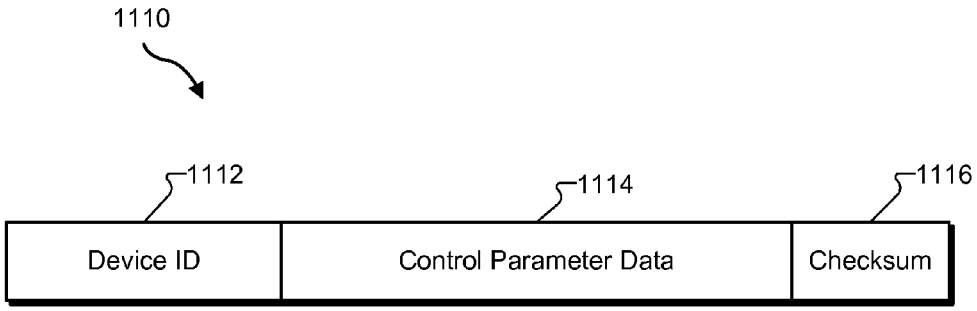
FIG. 11B illustrates exemplary contents of a data field included within the packet of FIG. 11A according to principles described herein.

FIG. 11B illustrates exemplary contents of data 1110. As shown in FIG. 11B, data 1110 may include a device ID 1112, control parameter data 1114, and checksum data 1116. Device ID 1112 may include a unique identifier of a particular sound processor and may be used to verify that packet 1100 is meant for the particular sound processor. In this manner, inadvertent control of one or more other sound processors in the vicinity of the particular sound processor may be avoided. Control parameter data 1114 may include data representative of one or more control parameters. For example, control parameter data 1114 may include data representative of one or more control parameter types and one or more control parameter values. Checksum data 1116 may be utilized by sound processing subsystem 102 to verify that the correct control parameter data 1114 is received.

Returning to FIG. 10, the output of packet encapsulator 1004 is input into modulator 1006. Modulator 1006 may be configured to modulate the control parameters (e.g., in the form of a packet) onto a carrier signal. Any suitable modulation scheme may be used by modulator 1006 as may serve a particular application. For example, modulator 1006 may use a frequency shift keying ("FSK") modulation scheme to modulate the control parameters onto a carrier signal.

In some examples, modulator 1006 is implemented by pre-storing audio waveforms in storage facility 508. For example, waveforms for the pilot tones and bits 0 and 1 may be pre-computed and stored in flash memory. Modulator 1006 may then determine which waveform is to be sent to the speaker (via a digital-to-analog converter ("DAC")) in accordance with the data included within packet 1100. In this manner, processing speed may be optimized.

Acoustic transmitter 1008 may be configured to transmit the modulated signal as a control signal to sound processing subsystem 102. Any suitable combination of hardware, software, and firmware may be used to implement acoustic transmitter 1008 as may serve a particular application.

Figure 12:
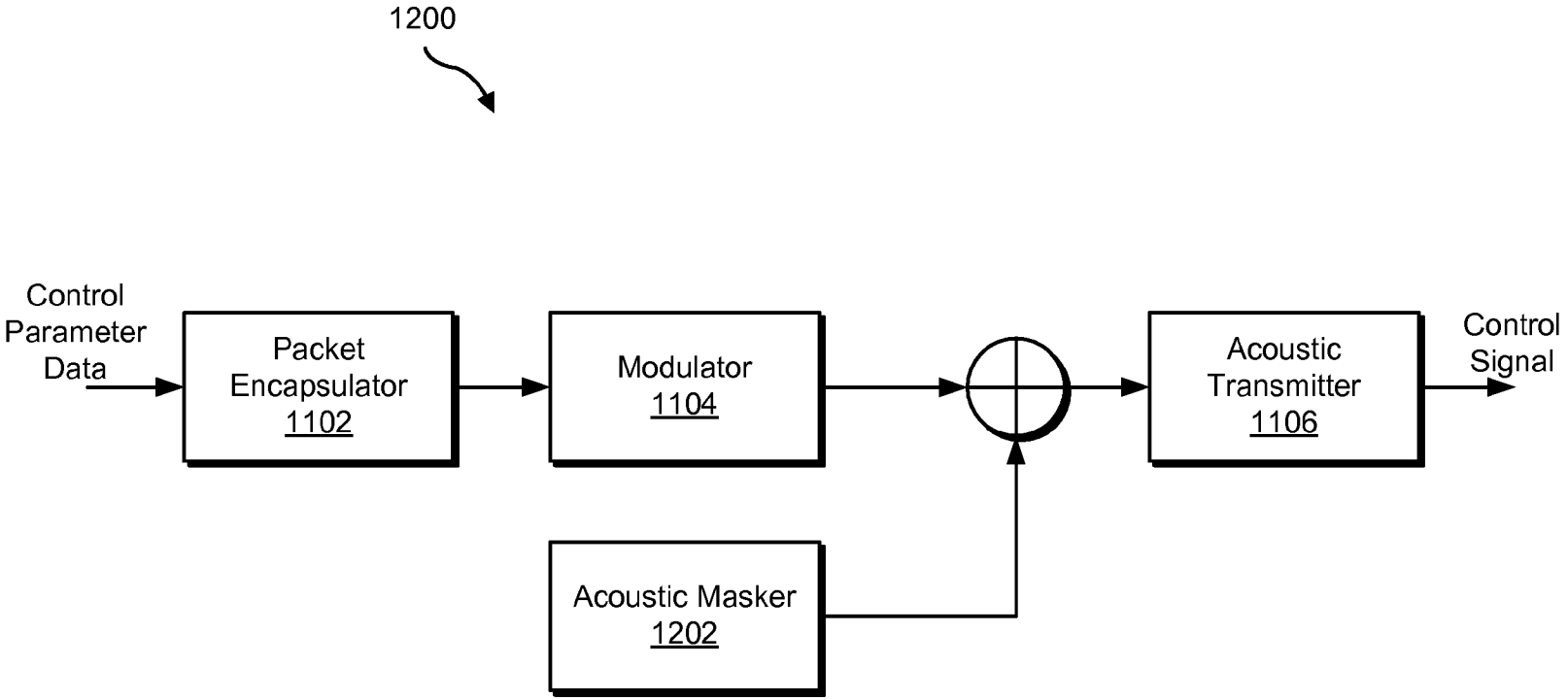
FIG. 12 shows an implementation of a remote control subsystem that may include an acoustic masker according to principles described herein.

For some cochlear implant patients, sustained exposure to the high frequency tones included within the acoustically transmitted control signal can be unpleasant, uncomfortable, and/or annoying. Hence, remote control subsystem 106 may be configured to mask the frequency tones with more pleasing sounds. For example, FIG. 12 shows an implementation 1200 of remote control subsystem 106 that may include an acoustic masker 1202 configured to generate and add masking acoustic content to the modulated signal output by modulator 1104 before acoustic transmitter 1106 transmits the control signal. Acoustic masker 1202 may generate and add masking acoustic content to the modulated signal output by modulator 1104 in any suitable manner as may serve a particular application.

Returning to FIG. 9, in step 904, the control signal acoustically transmitted in step 902 is detected by a sound processing subsystem that is communicatively coupled to a stimulation subsystem. For example, the control signal may be detected by a microphone (e.g., microphone 702) communicatively coupled to a sound processor (e.g., sound processor 704).

In step 906, the one or more control parameters are extracted by the sound processing subsystem from the control signal. The one or more control parameters may be extracted in any suitable manner as may serve a particular application.

Figure 13:
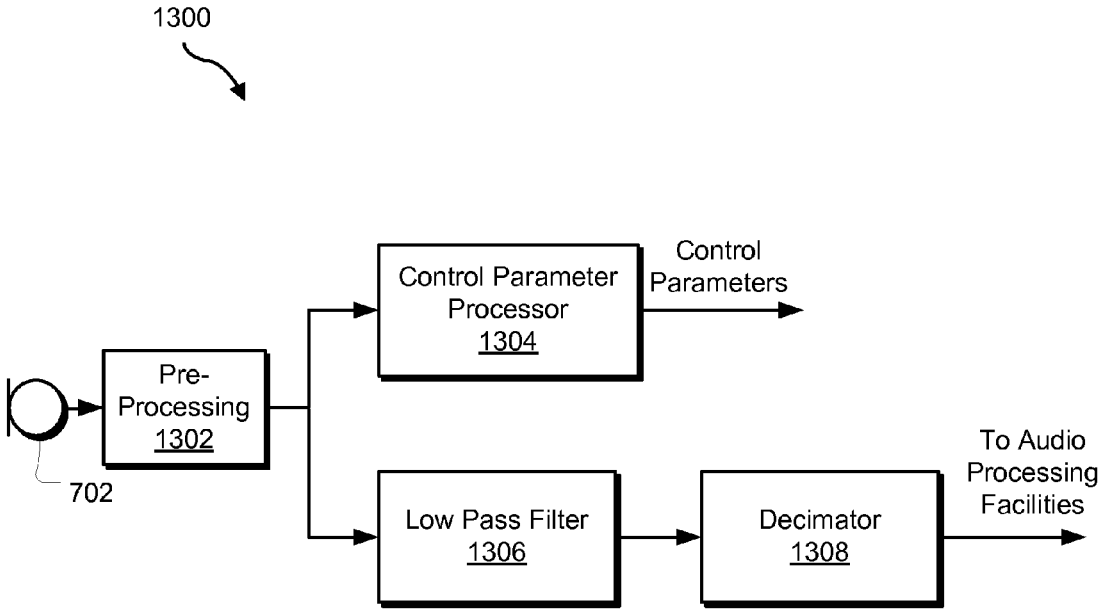
FIG. 13 illustrates an exemplary implementation of a sound processing subsystem that may be configured to detect an acoustically transmitted control signal and extract one or more control parameters from the control signal according to principles described herein.

Steps 904 and 906 will be illustrated in connection with FIG. 13. FIG. 13 illustrates an exemplary implementation 1300 of sound processing subsystem 102 that may be configured to detect an acoustically transmitted control signal and extract one or more control parameters from the control signal. As shown in FIG. 13, implementation 1300 may include microphone 702, pre-processing unit 1302, control parameter processor 1304, low pass filter 1306, and decimator 1308.

In some examples, microphone 702 may simultaneously detect an acoustically transmitted control signal and an audio signal containing acoustic content meant to be heard by the patient. Because the control signal includes frequency content within a different frequency range than the frequency content of the audio signal, sound processing subsystem 102 may separate the audio signal from the control signal by passing the signals through low pass filter 1306. The filtered audio signal may then be decimated by decimator 1308 and forwarded on to the other audio processing facilities described in FIG. 3 and FIG. 7.

The signals may also be presented to control parameter processor 1304, which may be configured to process content contained within the frequency range associated with the control signal. In some examples, control parameter processor 1304 may detect the speaker initialization tones 1102, the pilot tones 1104 and 1106, and the start of packet marker 1108 and begin sampling the data 1110 accordingly in order to extract the control parameter data 1114 from the control signal. In this manner, the control parameters may be extracted from the control signal and used by sound processing subsystem 102 to perform one or more operations.

Returning to FIG. 9, in step 908, one or more operations are performed in accordance with the one or more control parameters extracted from the control signal in step 906. For example, stimulation subsystem 102 may adjust one or more volume control parameters, program selection parameters, operational state parameters (e.g., parameters that turn a sound processor and/or an implantable cochlear stimulator on or off), audio input source selection parameters, fitting parameters, noise reduction parameters, microphone sensitivity parameters, microphone direction parameters, pitch parameters, timbre parameters, sound quality parameters, most comfortable current levels ("M levels"), threshold current levels, channel acoustic gain parameters, front and back-end dynamic range parameters, current steering parameters, pulse rate values, pulse width values, frequency parameters, amplitude parameters, waveform parameters, electrode polarity parameters (i.e., anode-cathode assignment), location parameters (i.e., which electrode pair or electrode group receives the stimulation current), stimulation type parameters (i.e., monopolar, bipolar, or tripolar stimulation), burst pattern parameters (e.g., burst on time and burst off time), duty cycle parameters, spectral tilt parameters, filter parameters, and dynamic compression parameters, and/or any other stimulation parameter, fitting parameter, or other control parameter associated with sound processing subsystem 102 and/or stimulation subsystem 104 as may serve a particular application.

Figure 14:
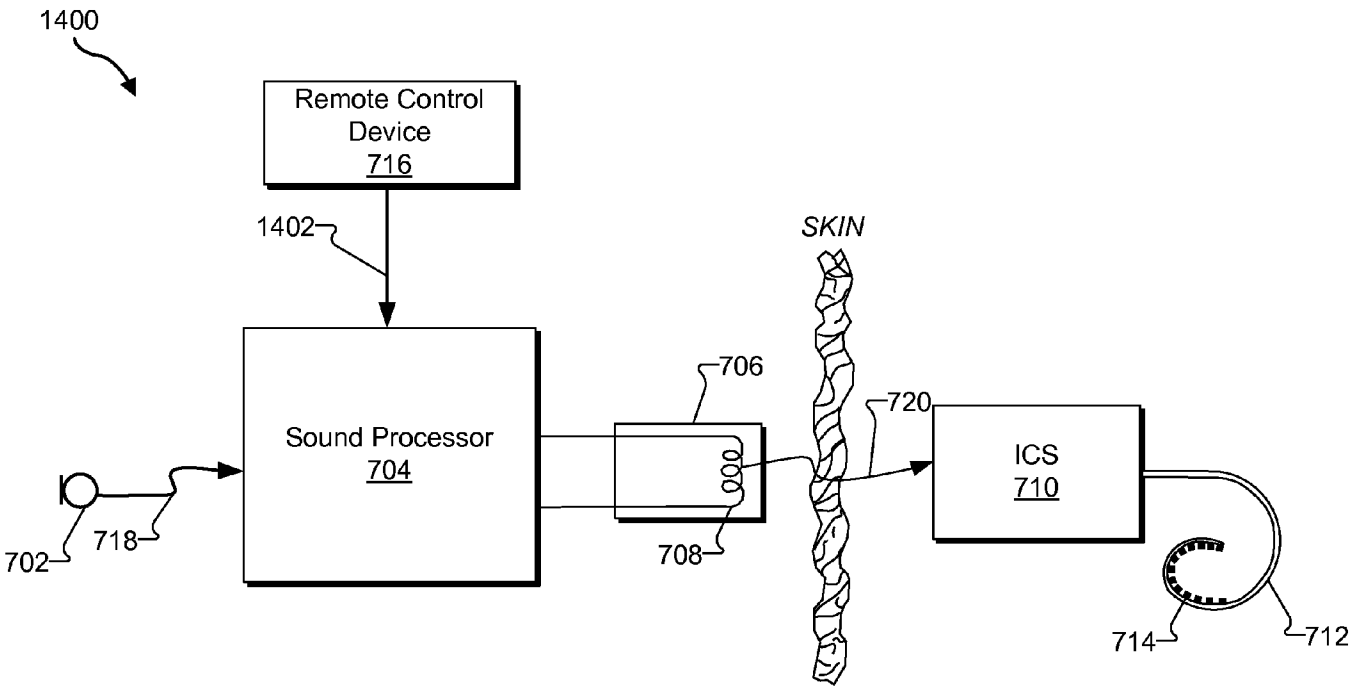
FIG. 14 shows an exemplary implementation of the system of FIG. 1 according to principles described herein.

As mentioned, remote control device 716 may be configured to acoustically transmit a control signal over a wired communication channel. For example, FIG. 14 shows an exemplary implementation 1400 of system 100 wherein remote control device 716 acoustically transmits a control signal over wired communication channel 1402 to sound processor 704. For example, remote control device 716 may be directly connected to an audio input terminal of sound processor 704. Such direct connection may be advantageous in acoustic situations where signal integrity of the control signal may be compromised. In some examples, the control signal may be transmitted in baseband format (i.e., without any modulation). In this manner, relative high transfer rates may be utilized.

Figure 15:
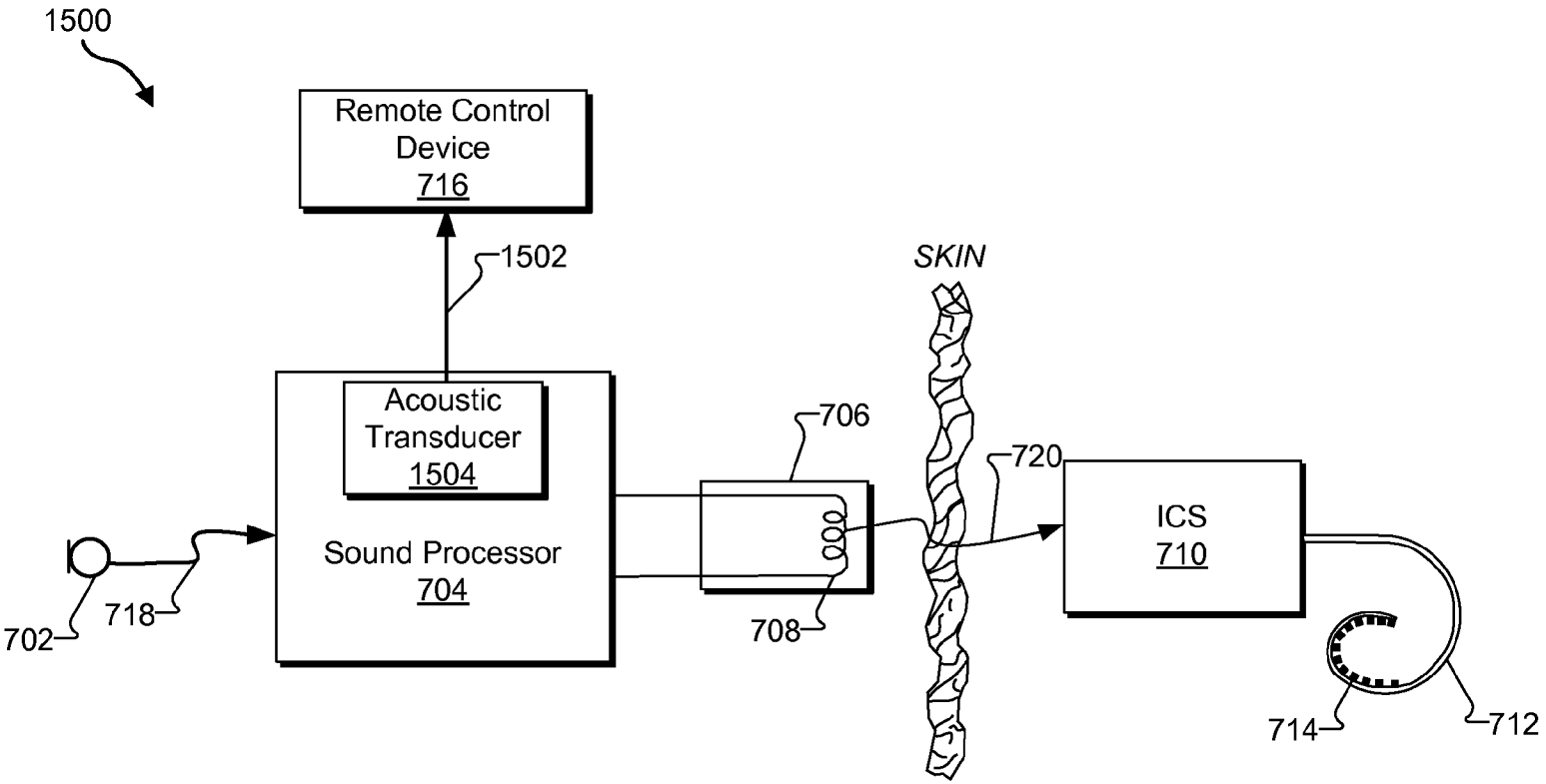
FIG. 15 illustrates another exemplary implementation of the system of FIG. 1 according to principles described herein.

FIG. 15 illustrates another implementation 1500 of system 100 wherein sound processor 704 includes an acoustic transducer 1504 (e.g., a microphone, an acoustic buzzer, or other device). Acoustic transducer 1504 may be configured to acoustically transmit one or more status signals, confirmation signals, or other types of signals to remote control device 716. For example, a confirmation signal may be transmitted to remote control device 716 after each successful receipt and execution of one or more control commands. The confirmation signal may include, in some examples, data representative of one or more actions performed by sound processor 704 (e.g., data representative of one or more changed control parameters). To facilitate receipt of such communication, remote control device 716 may include a microphone or other receiver.

Sound processor 704 may additionally or alternatively include any other means of confirming or acknowledging receipt and/or execution of one or more control commands. For example, sound processor 704 may include one or more LEDs, digital displays, and/or other display means configured to convey to a user that sound processor 704 has received and/or executed one or more control commands.

Figure 16:
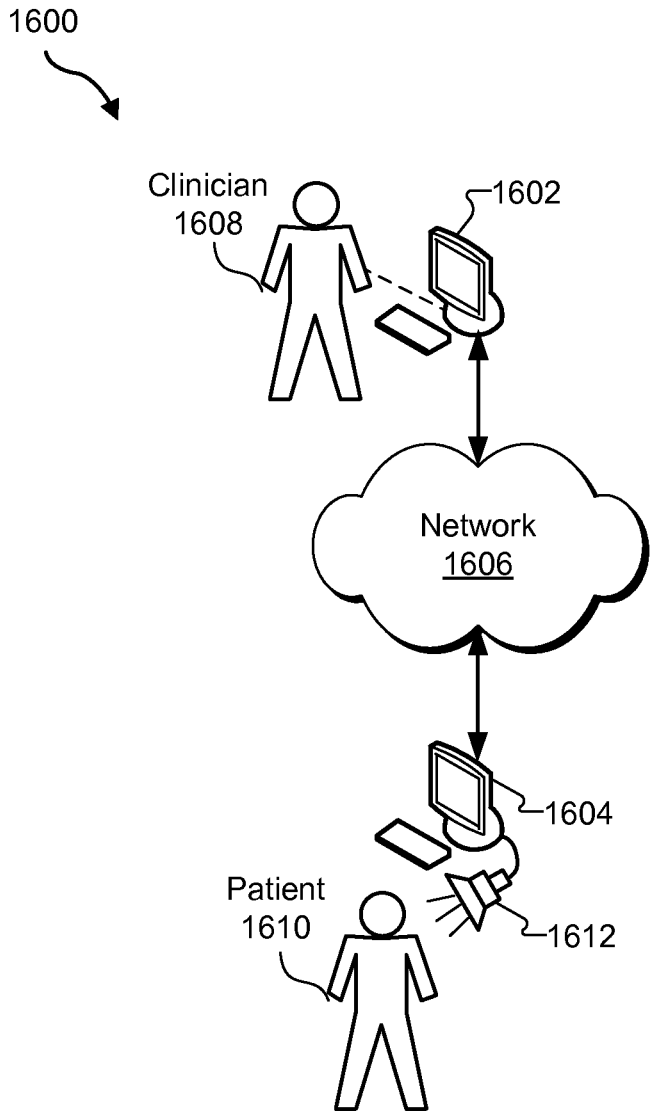
FIG. 16 illustrates another exemplary implementation of the system of FIG. 1 according to principles described herein.

FIG. 16 illustrates another implementation 1600 of system 100 wherein remote control subsystem 106 is implemented by network-enabled computing devices 1602 and 1604. As shown in FIG. 16, computing devices 1602 and 1604 are communicatively coupled via a network 1606. Network 1606 may include one or more networks or types of networks capable of carrying communications and/or data signals between computing device 1602 and computing device 1604. For example, network 1606 may include, but is not limited to, the Internet, a cable network, a telephone network, an optical fiber network, a hybrid fiber coax network, a wireless network (e.g., a Wi-Fi and/or mobile telephone network), a satellite network, an intranet, local area network, any/or other suitable network as may serve a particular application.

As shown in FIG. 16, computing device 1602 may be associated with a clinician 1608. Computing device 1602 may include a personal computer, a fitting station, a handheld device, and/or any other network-enabled computing device as may serve a particular application.

Computing device 1604 may be associated with a cochlear implant patient 1610. Computing device 1604 may include a personal computer, mobile phone device, handheld device, audio player, and/or any other computing device as may serve a particular application. As shown in FIG. 16, computing device 1604 may be communicatively coupled to a speaker 1612.

Clinician 1608 may utilize computing device 1602 to adjust one or more control parameters of a sound processor (e.g., sound processor 704) and a cochlear implant (e.g., cochlear stimulator 710) used by patient 1610. For example, clinician 1608 may utilize computing device 1602 to stream and/or otherwise transmit a control signal comprising one or more fitting parameters in the form of an audio file (e.g., an mp3, way, dss, or wma file) to computing device 1604 by way of network 1606. The audio file may be presented to patient 1610 via speaker 1612. In this manner, clinician may remotely perform one or more fitting procedures and/or otherwise control an operation of sound processor 704 and/or cochlear stimulator 710. Such remote control may obviate the need for the patient 1610 to personally visit the clinician's office in order to undergo a fitting procedure or otherwise adjust an operation of his or her cochlear prosthesis.

In some examples, clinician 1608 and/or any other user may provide on demand audio files containing one or more control signals configured to adjust one or more control parameters associated with a sound processor 704 and/or a cochlear stimulator 710. For example, the audio files may be posted on a webpage, included within a compact disk, or otherwise disseminated for use by patient 1610. Patient 1610 may acquire the audio files and play the audio files using computing device 1604 at a convenient time that.

Figure 17:
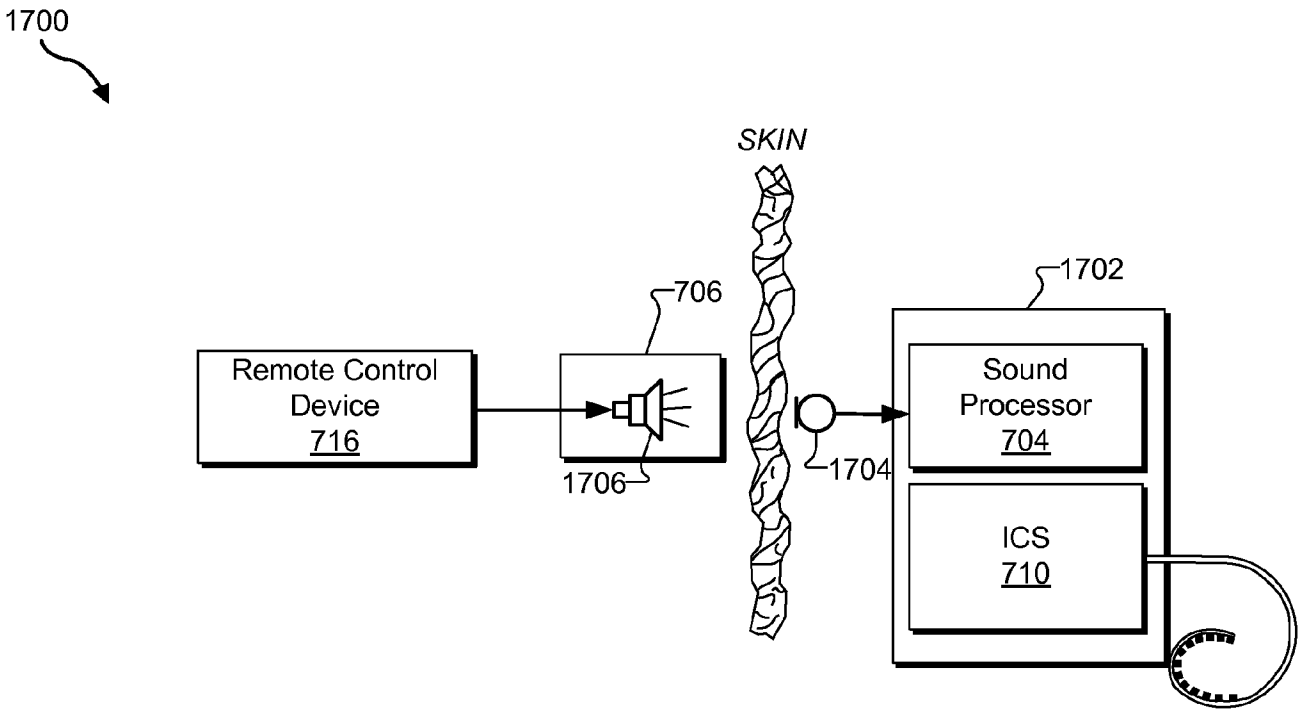
FIG. 17 illustrates another exemplary implementation of the system of FIG. 1 according to principles described herein.

FIG. 17 illustrates another exemplary implementation 1700 of system 100 wherein sound processor 704 and implantable cochlear stimulator 710 are included within a fully implantable module 1702. As shown in FIG. 17, fully implantable module 1702 may be entirely implanted within the cochlear implant patient. An internal microphone 1704 may be communicatively coupled to sound processor 704 and configured to detect one or more control signals acoustically transmitted by remote control device 716 by way of speaker 1706. As shown in FIG. 17, speaker 1706 may be disposed within headpiece 706. In this configuration, speaker 1706 and microphone 1704 are located in relatively close proximity one to another. Such close proximity may facilitate increased signal to noise ratio of audio signals detected by microphone 1704, thereby facilitating the use of relatively high data rates.

As mentioned, remote control subsystem 106 may be implemented by a mobile phone device. For example, FIG. 18 illustrates an exemplary mobile phone device 1800 configured to run a remote control emulation application that allows mobile phone device 1800 to generate and acoustically transmit one or more control parameters to sound processing subsystem 102.

Figure 18:
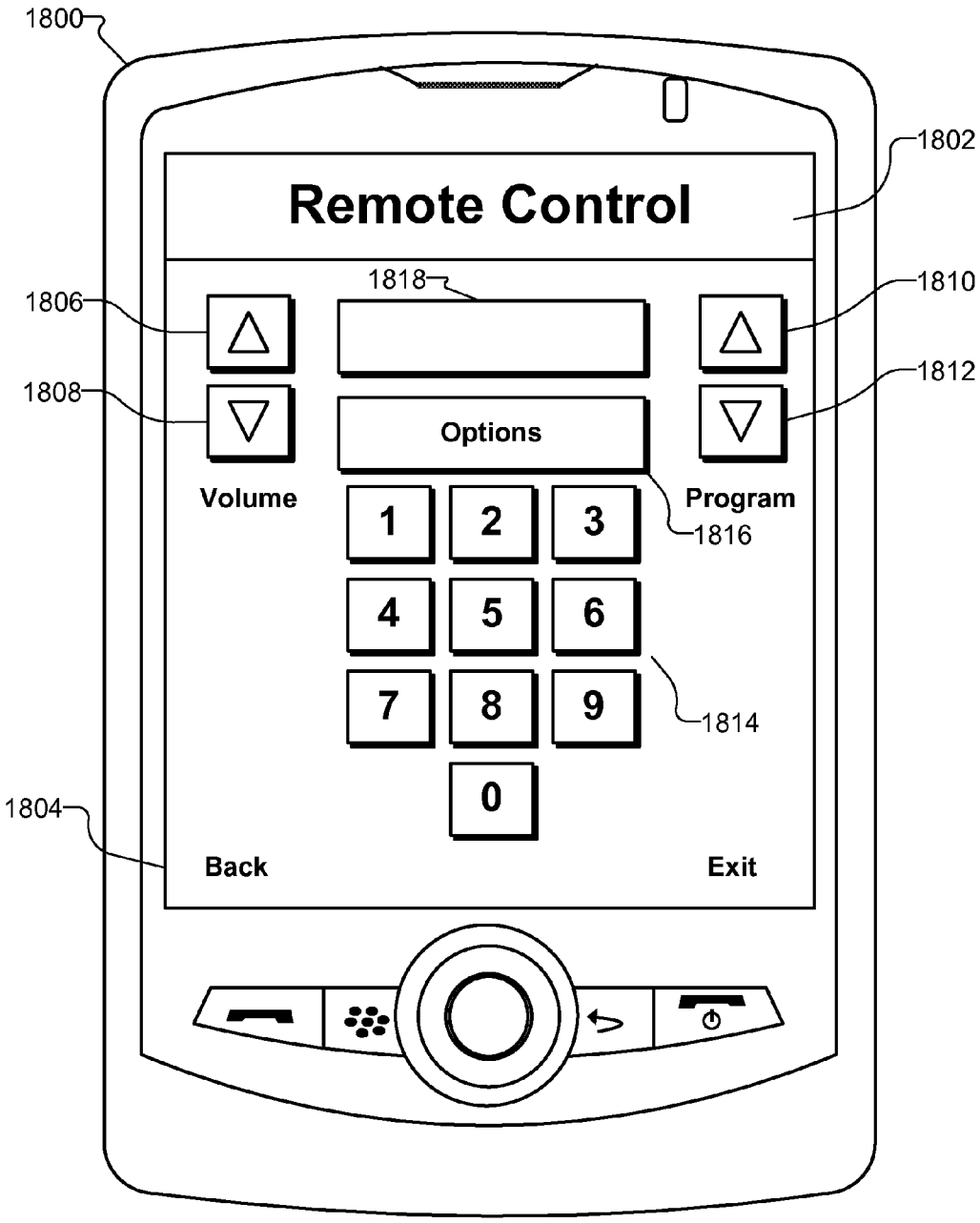
FIG. 18 illustrates an exemplary mobile phone device 1800 configured to run a remote control emulation application according to principles described herein.

As shown in FIG. 18, mobile phone device 1800 may be configured to display a remote control emulation graphical user interface ("GUI") 1802 that may be displayed on a display screen 1804 of mobile phone device 1800 and configured to facilitate inputting of one or more user input commands. For example, remote control emulation GUI 1802 may include a plurality of graphical objects representative of buttons that may be selected by a user to input one or more user input commands. To illustrate, graphical objects 1806 and/or 1808 may be selected by a user to adjust a volume level of an audio signal being presented to a cochlear implant patient. Additionally or alternatively, graphical objects 1810 and/or 1812 may be selected by a user to direct sound processing subsystem 102 to switch to from one operating program to another. Graphical objects 1814 may be representative of a number pad and may be selected to input specific values of control parameters to be acoustically transmitted to sound processing subsystem 102. Graphical object 1816 may be selected to access one or more options associated with remote control emulation GUI 1802. Display field 1818 may be configured to display specific values of one or more control parameters and/or any other information as may serve a particular application. It will be recognized that GUI 1802 is merely illustrative of the many different GUIs that may be provided to control one or more operations of sound processing subsystem 102 and/or stimulation subsystem 104.

Figure 19:
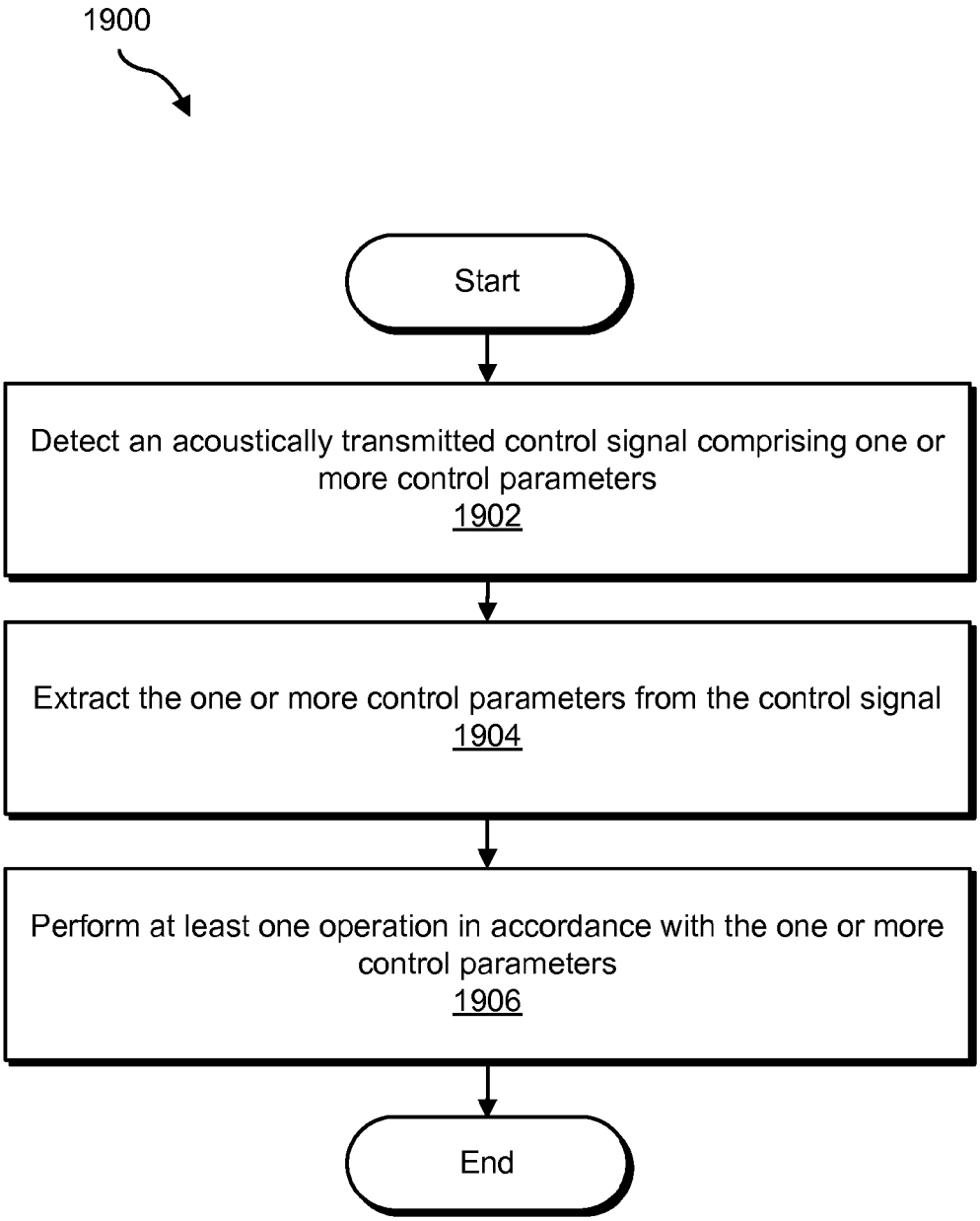
FIG. 19 illustrates another exemplary method of acoustically controlling a cochlear implant system according to principles described herein.

FIG. 19 illustrates another exemplary method 1900 of acoustically controlling a cochlear implant system. While FIG. 19 illustrates exemplary steps according to one embodiment, other embodiments may omit, add to, reorder, and/or modify any of the steps shown in FIG. 19. It will be recognized that any of the systems, subsystems, facilities, and/or modules described herein may be configured to perform one or more of the steps shown in FIG. 19.

In step 1902, an acoustically transmitted control signal comprising one or more control parameters is detected. The control signal may be detected by sound processing subsystem 102 in any of the ways described herein.

In step 1904, the one or more control parameters are extracted by the sound processing subsystem from the control signal. The one or more control parameters may be extracted in any of the ways described herein.

In step 1906, at least one operation is performed in accordance with the one or more control parameters extracted from the control signal in step 1904. The at least one operation may be performed in any of the ways described herein.

Figure 20:
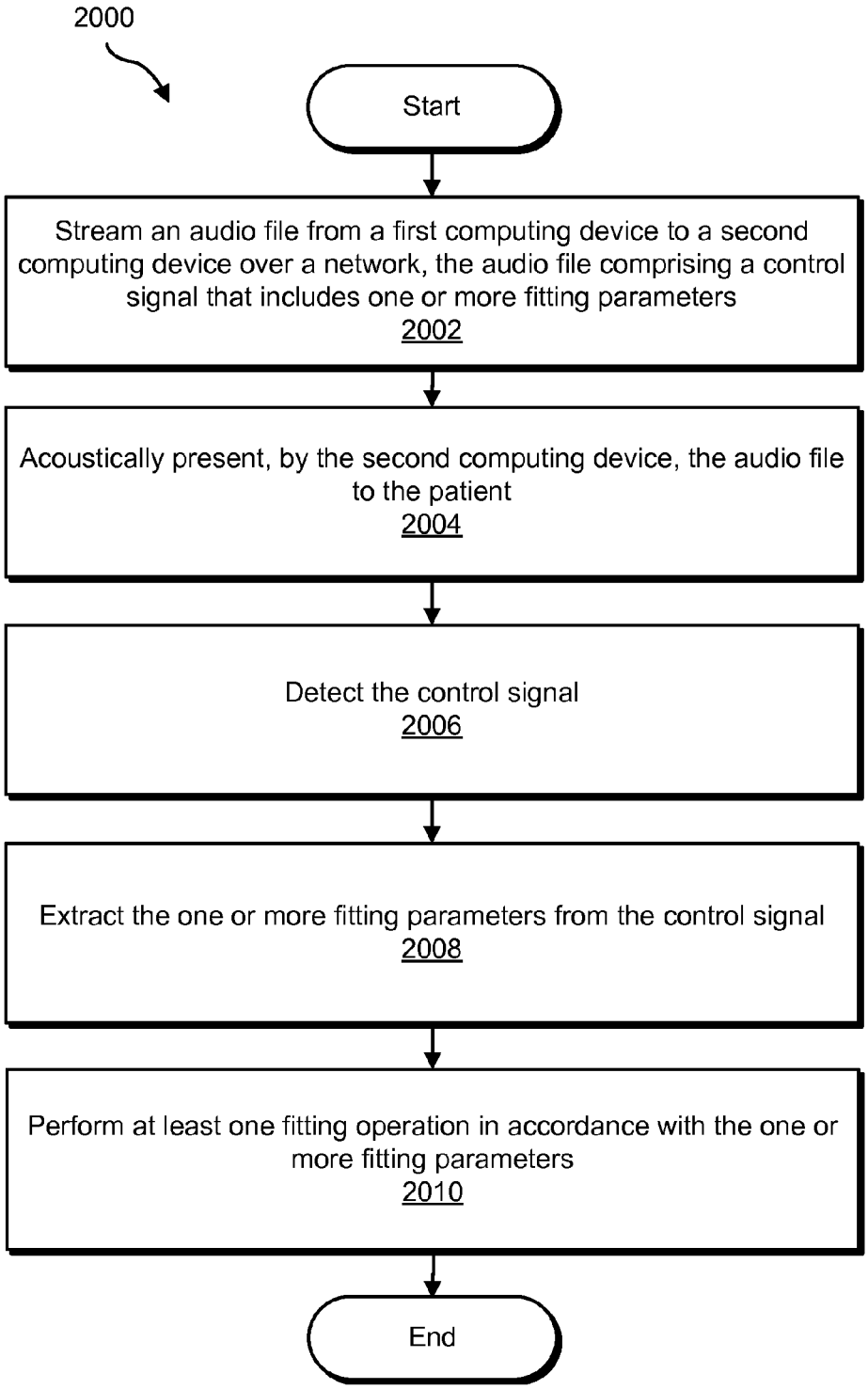
FIG. 20 illustrates a method of remotely fitting a cochlear implant system to a patient according to principles described herein.

FIG. 20 illustrates a method 2000 of remotely fitting a cochlear implant system to a patient. While FIG. 20 illustrates exemplary steps according to one embodiment, other embodiments may omit, add to, reorder, and/or modify any of the steps shown in FIG. 20. It will be recognized that any of the systems, subsystems, facilities, and/or modules described herein may be configured to perform one or more of the steps shown in FIG. 20.

In step 2002, an audio file is streamed by a first computing device (e.g., a computing device associated with a clinician) to a second computing device (e.g., a computing device associated with a patient) over a network. The audio file comprises a control signal that includes one or more fitting parameters. The audio file may be streamed in any of the ways described herein.

In step 2004, the audio file is acoustically presented by the second computing device to the patient by the computing device. The audio file may be acoustically presented in any of the ways described herein.

In step 2006, the control signal contained within the audio file is detected. The control signal may be detected in any of the ways described herein.

In step 2008, the one or more fitting parameters are extracted from the control signal. The fitting parameters may be extracted in any of the ways described herein.

In step 2010, at least one fitting operation is performed in accordance with the one or more fitting parameters extracted from the control signal in step 2008. The at least one fitting operation may be performed in any of the ways described herein.

The preceding examples have been in the context of a single sound processor that controls a single implantable cochlear stimulator. However, it will be recognized that remote control subsystem 106 may be configured to control bilateral sound processors in a similar manner.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method comprising:

generating, by a remote control subsystem, an audio control signal that comprises a first pilot audio tone having a first audio frequency and a second pilot audio tone having a second audio frequency, the first and second pilot audio tones configured to indicate a time to start sampling data representative of one or more control parameters included in the audio control signal;

acoustically transmitting, by the remote control subsystem, the audio control signal to a sound processing subsystem communicatively coupled to a stimulation subsystem implanted within a patient;

detecting, by the sound processing subsystem, the first and second pilot audio tones included in the audio control signal;

starting to sample, by the sound processing subsystem, the data included in the audio control signal at the time indicated by the first and second pilot audio tones;

extracting, by the sound processing subsystem, the data representative of the one or more control parameters from the audio control signal while sampling the data included in the audio control signal; and performing, by the sound processing subsystem, at least one operation in accordance with the data representative of the one or more control parameters extracted from the audio control signal.

2. The method of claim 1, further comprising:

detecting, by the sound processing subsystem, an audio signal presented to the patient; and directing, by the sound processing subsystem, the stimulation subsystem to generate and apply electrical stimulation representative of the audio signal to one or more stimulation sites within the patient;

wherein the audio control signal comprises frequency content outside a frequency range associated with the audio signal.

3. The method of claim 2, wherein the audio control signal and the audio signal are concurrently detected by the sound processing subsystem.

4. The method of claim 2, wherein the frequency content of the audio control signal is within a frequency range that is higher than the frequency range associated with the audio signal.

5. The method of claim 1, wherein the acoustically transmitting comprises acoustically transmitting the audio control signal with a speaker included within the remote control subsystem.

6. The method of claim 1, wherein the acoustically transmitting comprises transmitting the audio control signal over a wired communication channel.

7. The method of claim 1, wherein the detecting of the audio control signal comprises detecting the audio control signal with a microphone included within the sound processing subsystem.

8. The method of claim 1, further comprising generating, by the remote control subsystem, the audio control signal by modulating the data representative of the one or more control parameters onto a carrier signal.

9. The method of claim 8, wherein the modulation is performed using a frequency shift keying modulation scheme.

10. The method of claim 1, further comprising:

receiving, by the remote control subsystem, a user input command to initiate the acoustic transmitting of the audio control signal.

11. The method of claim 1, further comprising adding masking acoustic content to the audio control signal prior to acoustically transmitting the audio control signal.

12. The method of claim 1, wherein the sound processing subsystem and the stimulation subsystem are fully implanted within the patient.

13. The method of claim 1, wherein the one or more control parameters comprise at least one of a volume control parameter, a program selection parameter, an operational state parameter, an audio input source selection parameter, a fitting parameter, a noise reduction parameter, a microphone direction parameter, a microphone sensitivity parameter, a compensation current parameter, a stimulation type parameter, a pitch parameter, a timbre parameter, a sound quality parameter, a most comfortable current level parameter, a threshold current level parameter, a channel acoustic gain parameter, a dynamic range parameter, a current steering parameters, a pulse rate value, a pulse width value, a frequency parameter, an amplitude parameter, a waveform parameter, an electrode polarity parameter, a location parameter, a burst pattern parameter, a duty cycle parameter, a spectral tilt parameter, a filter parameter, and a dynamic compression parameter.

14. The method of claim 1, wherein each of the first and second pilot audio tones comprises a windowed frequency burst.

15. A method comprising:

detecting, by a sound processing subsystem communicatively coupled to a stimulation subsystem implanted within a patient, an acoustically transmitted audio control signal comprising a first pilot audio tone having a first audio frequency and a second pilot audio tone having a second audio frequency, the first and second pilot audio tones configured to indicate a time to start sampling data representative of one or more control parameters included in the audio control signal;

starting to sample, by the sound processing subsystem, the data included in the audio control signal at the time indicated by the first and second pilot audio tones;

extracting, by the sound processing subsystem, the data representative of the one or more control parameters from the audio control signal while sampling the data included in the audio control signal; and performing, by the sound processing subsystem, at least one operation in accordance with the one or more control parameters represented by the data extracted from the audio control signal.

16. A method of remotely fitting a cochlear implant system to a patient, the method comprising:

streaming, by a first computing device, an audio file to a second computing device over a network, the audio file comprising an audio control signal that includes data representative of one or more fitting parameters, and a first pilot audio tone having a first audio frequency and a second pilot audio tone having a second audio frequency, the first and second pilot audio tones configured to indicate a time to start sampling the data included in the audio control signal;

acoustically presenting, by the second computing device, the audio file to the patient;

detecting, by a sound processing subsystem included within the cochlear implant system, the first and second pilot audio tones included in the audio file;

starting to sample, by the sound processing subsystem, the data included in the audio control signal at the time indicated by the first and second pilot audio tones;

extracting, by the sound processing subsystem, the data representative of the one or more fitting parameters from the audio control signal while sampling the data included in the audio control signal; and performing, by the sound processing subsystem, at least one fitting operation in accordance with the data representative of the one or more fitting parameters extracted from the audio control signal.

17. A system comprising:

a remote control device configured to generate an audio control signal that comprises a first pilot audio tone having a first audio frequency and a second pilot audio tone having a second audio frequency, the first and second pilot audio tones configured to indicate a time to start sampling data representative of one or more control parameters included in the audio control signal, and acoustically transmit the audio control signal; and a sound processor communicatively coupled to the remote control device and configured to detect the first and second pilot audio tones included in the audio control signal, start sampling the data included in the audio control signal at the time indicated by the first and second pilot audio tones one or more audio tones, extract the data representative of the one or more control parameters from the audio control signal while sampling the data included in the audio control signal, and perform at least one operation in accordance with the data representative of the one or more control parameters extracted from the audio control signal.

18. The system of claim 17, further comprising:

an implantable cochlear stimulator communicatively coupled to the sound processor;

wherein the sound processor is further configured to detect an audio signal presented to a patient, and direct the implantable cochlear stimulator to generate and apply electrical stimulation representative of the audio signal to one or more stimulation sites within the patient;

wherein the audio control signal comprises frequency content outside a frequency range associated with the audio signal.

19. The system of claim 17, wherein the remote control device comprises a mobile phone device configured to run a remote control emulation application.

20. The system of claim 17, wherein the one or more control parameters comprise at least one of a volume control parameter, a program selection parameter, an operational state parameter, an audio input source selection parameter, a fitting parameter, a noise reduction parameter, a microphone direction parameter, a microphone sensitivity parameter, a compensation current parameter, a stimulation type parameter, a pitch parameter, a timbre parameter, a sound quality parameter, a most comfortable current level parameter, a threshold current level parameter, a channel acoustic gain parameter, a dynamic range parameter, a current steering parameters, a pulse rate value, a pulse width value, a frequency parameter, an amplitude parameter, a waveform parameter, an electrode polarity parameter, a location parameter, a burst pattern parameter, a duty cycle parameter, a spectral tilt parameter, a filter parameter, and a dynamic compression parameter.

* * * * *